US007188389B2

(12) United States Patent
Moine et al.

(10) Patent No.: US 7,188,389 B2
(45) Date of Patent: Mar. 13, 2007

(54) DIRT COLLECTING SYSTEM FOR A FLOOR CARE APPLIANCE

(75) Inventors: David W. Moine, North Canton, OH (US); David J. Boles, Barberton, OH (US); Nick M. Bosyi, North Canton, OH (US); Kurt D. Harsh, North Canton, OH (US); Jackson W. Wegelin, Akron, OH (US)

(73) Assignee: The Hoover Company, North Canton, OH (US)

( * ) Notice: Subject to any disclaimer, the term of this patent is extended or adjusted under 35 U.S.C. 154(b) by 427 days.

(21) Appl. No.: 10/256,724

(22) Filed: Sep. 27, 2002

(65) Prior Publication Data

US 2003/0037405 A1 Feb. 27, 2003

Related U.S. Application Data

(63) Continuation-in-part of application No. 10/142,316, filed on May 8, 2002, which is a continuation-in-part of application No. 10/044,774, filed on Jan. 11, 2002, now Pat. No. 6,772,475.

(60) Provisional application No. 60/266,713, filed on Feb. 6, 2001.

(51) Int. Cl.
*A47L 9/10* (2006.01)
*A47L 9/14* (2006.01)

(52) U.S. Cl. ..... 15/347; 15/351

(58) Field of Classification Search ..... 15/339, 15/347, 350–353; 55/DIG. 2, DIG. 3, 330, 55/328, 422, 429; 96/416; 134/21
See application file for complete search history.

(56) References Cited

U.S. PATENT DOCUMENTS 980,832 A 1/1911 Pittelkow (Continued)

FOREIGN PATENT DOCUMENTS

CA 536415 1/1957

(Continued)

OTHER PUBLICATIONS

Copy of definitions are from Webster's New World Dictionary, Third College Edition, Copyright 1988.*

(Continued)

*Primary Examiner*—Terrence R. Till
(74) *Attorney, Agent, or Firm*—A. Burgess Lowe, Esq.; Michael J. Corrigan, Esq.

(57) ABSTRACT

The invention is a floor care appliance such as vacuum cleaner having several embodiments of a dirt particle separating and collecting system removably inserted and sidewardly disposed into a recess in the floor care appliance's housing. One embodiment of the dirt particle separating and collecting system includes a translucent dirt cup having an apertured wall between a dirt particle collecting chamber and a second chamber housing a primary filter. One other embodiment is a translucent bag container for housing a filtration bag. The filtration bag may or may not be disposable and may or may not have a HEPA rating. Other embodiments include utilizing a single dirt container for housing the apertured wall and primary filter combination, a filtration bag only, or a combination of a filtration bag and the apertured wall and primary filter combination. Portions of the various embodiments of the dirt collecting systems may be seen through cutaway portions of the cleaner housing.

21 Claims, 22 Drawing Sheets

U.S. PATENT DOCUMENTS

| | | | | |
|---|---|---|---|---|
| 1,127,896 | A | 2/1915 | Keller | |
| 2,569,865 | A | 10/1951 | Muska | 183/37 |
| 2,639,005 | A | 5/1953 | Gerstmann | 183/75 |
| 2,863,525 | A | 12/1958 | Lucian | 183/37 |
| 3,089,169 | A | 5/1963 | Parker et al. | 15/83 |
| 3,320,727 | A | 5/1967 | Farley et al. | 55/337 |
| 3,491,519 | A * | 1/1970 | Ettridge | 55/357 |
| 3,835,626 | A * | 9/1974 | Miyake et al. | 55/319 |
| 3,856,488 | A | 12/1974 | Kato et al. | 55/300 |
| 3,877,902 | A | 4/1975 | Eriksson et al. | 55/337 |
| 4,185,976 | A | 1/1980 | Kosik et al. | |
| 4,373,228 | A | 2/1983 | Dyson | 15/350 |
| 4,405,346 | A | 9/1983 | Tschudy et al. | |
| 4,426,211 | A | 1/1984 | Ataka et al. | |
| 4,573,234 | A | 3/1986 | Kochte et al. | |
| 4,665,582 | A * | 5/1987 | Richmond et al. | 15/344 |
| 4,718,924 | A | 1/1988 | DeMarco | 55/302 |
| D305,269 | S | 12/1989 | Dyson | D32/22 |
| 5,020,186 | A * | 6/1991 | Lessig et al. | 15/339 |
| 5,080,697 | A | 1/1992 | Finke | 55/97 |
| 5,107,567 | A | 4/1992 | Ferrari et al. | |
| 5,135,552 | A | 8/1992 | Weistra | 55/337 |
| 5,145,499 | A * | 9/1992 | Dyson | 55/337 |
| 5,395,279 | A * | 3/1995 | McCann | 446/487 |
| D365,669 | S | 12/1995 | Piccaluga et al. | D32/22 |
| D375,820 | S | 11/1996 | Piccaluga | D32/22 |
| 5,664,285 | A | 9/1997 | Melito et al. | |
| 5,735,403 | A | 4/1998 | Stiglianese | 209/23 |
| 5,779,745 | A * | 7/1998 | Kilstrom | 55/337 |
| 5,788,848 | A | 8/1998 | Blanche et al. | 210/162 |
| 5,935,279 | A | 8/1999 | Kilstrom | 55/237 |
| D413,698 | S | 9/1999 | Dyson | D32/22 |
| 5,946,769 | A | 9/1999 | Sprinkle | 15/321 |
| 6,003,196 | A * | 12/1999 | Wright et al. | 15/353 |
| 6,026,540 | A * | 2/2000 | Wright et al. | 15/347 |
| 6,260,234 | B1 * | 7/2001 | Wright et al. | 15/353 |
| 6,385,810 | B1 * | 5/2002 | Lang | 15/352 |
| 6,514,325 | B2 * | 2/2003 | Cox et al. | 96/69 |
| 2001/0018865 | A1 * | 9/2001 | Wegelin et al. | 95/268 |
| 2002/0133901 | A1 * | 9/2002 | Ohta et al. | 15/347 |
| 2002/0162188 | A1 * | 11/2002 | Harmen | 15/353 |

FOREIGN PATENT DOCUMENTS

| | | | |
|---|---|---|---|
| EP | 0018197 | | 4/1980 |
| EP | 99/30602 | | 6/1999 |
| EP | 1070478 | A2 | 1/2001 |
| EP | 1 181 886 | A2 | 2/2007 |
| GB | 737457 | | 9/1955 |
| GB | 2 092 472 | A | 8/1982 |
| GB | 2246717 | A | 12/1992 |
| GB | 2 321 181 | A | 7/1998 |
| GB | 2 359 984 | A | 9/2001 |
| GB | 2 368 005 | A | 4/2002 |
| SE | 119307 | | 7/1947 |
| WO | 9930604 | | 6/1999 |
| WO | WO 00/35331 | * | 6/2000 |

OTHER PUBLICATIONS

2 Photographs of Carton for Gore Cleanstream Filter No. 090783 manufactured at least as early as Sep. 1996.

Photographs of Dyson Model DC-03 upright cleaner purchased Jun. 15, 1998.

Photographs of Hoover U.K. Model No. V2000 "Vortex" received on Nov. 30, 2000.

Photographs of Sharp Model EC-T5180A upright cleaner purchased Mar. 2002.

Photographs of Hoover Conquest Model No. U7069-103 received on Mar. 24, 1994.

Photographs of Hoover Conquest Model No. U7070-080 received on Aug. 8, 1990.

Search Report conducted by the British Patent Office and dated Aug. 29, 2003, citing the documents identified in the "Foreign Patent Documents" section above.

* cited by examiner

DIRT COLLECTING SYSTEM FOR A FLOOR CARE APPLIANCE

RELATED APPLICATIONS

This application is a continuation-in-part application of U.S. Ser. No. 10/142,316 filed on May 8, 2002 which is a continuation-in-part application of U.S. Ser. No. 10/044,774 filed on Jan. 11, 2002 which issued as U.S. Pat. No. 6,772,475 which sought the benefit of priority of U.S. Provisional Application No. 60/266,713 dated Feb. 6, 2001.

BACKGROUND OF THE INVENTION

1. Field of the Invention

This invention relates to a floor care appliance such as a vacuum cleaner and, more specifically, to a vacuum cleaner having several embodiments of a dirt collecting system.

2. Summary of the Prior Art

Upright vacuum cleaners are well known in the art. Typically, these upright vacuum cleaners include a vacuum cleaner housing pivotally mounted to a vacuum cleaner foot. The foot is formed with a nozzle opening and may include an agitator mounted therein for loosening dirt and debris from a floor surface. A motor may be mounted to either the foot or the housing for producing suction at the nozzle opening. The suction at the nozzle opening picks up the loosened dirt and debris and produces a stream of dirt-laden air which is ducted to the vacuum cleaner housing.

It is known in the art to provide vacuum cleaners with interchangeable particle separating and dirt collecting systems. Recent consumer demand has forced floor care appliance and vacuum cleaner designers to design floor care appliances and vacuum cleaners with improved performance, particularly with respect to filtration performance. An example of a floor care appliance with improved cleaning and filtration performance is found in U.S. Pat. No. 6,596,044 issued to Bilek et al., owned by a common assignee, and incorporated by reference fully herein. The dirt collecting system presented therein utilizes a filtration member utilizing a layer of expanded polytetrafluoroethylene (ePTFE) as the filtration media which is known to have superior filtration characteristics with the convenience of a bagless dirt cup. At the same time, consumers wish to retain the choice in which type of dirt collecting system the cleaner employs, especially with respect to utilizing a disposable or otherwise filtration bag which some consumers regards as more desirable, along with the other features disclosed herein. The present invention is a dirt collecting system for a floor care appliance having several embodiments giving consumers a choice of selecting a filtration media comprised of an apertured wall and a filter, a filtration bag only, or a combination of a filtration bag and the apertured wall and filter combination.

It is an object of the invention to provide an improved floor care appliance having an interchangeable particle separating and collecting system.

It is yet still another object of the invention to provide an improved floor care appliance having an interchangeable particle separating and collecting system utilizing a single dirt container wherein in one embodiment the particle separating system consists of a filtration bag only, in another embodiment it is comprised of a filtration bag and an apertured wall/filtration cartridge combination, and in another embodiment an apertured wall/filtration cartridge combination only.

SUMMARY OF THE INVENTION

The invention is an upright vacuum cleaner which includes a foot having a downwardly disposed suction nozzle, rear wheels and more forwardly disposed intermediate wheels. These last mentioned wheels are carried on a pivot carriage structure on the suction nozzle so that they may pivot inwardly and outwardly of the suction nozzle to thereby adjust its height. A housing is pivotally attached to the foot via a pivoting duct assembly so that a dirt laden airstream from the suction nozzle is directed to a dirt separation assembly in the housing. The suction nozzle has symmetric left and right agitator chambers having a suction duct disposed along either the front edge of each of the agitator chambers or along the rear edges of each of the agitator chambers, or both. A pair of rotary agitators are disposed inside the agitator chambers wherein a half-section of each agitator is located in the respective left and right agitator chambers. The pair of rotary agitators are comprised of a front and rear agitator each divided in the center into a right and left half-section by a centrally disposed gear box. The centrally disposed gear box further serves to divide the main opening of the suction nozzle into the left and right agitator chambers.

A one-piece semi-cylindrical shaped tunnel liner serves to partially separate the twin agitator chambers from a pair of air passages that extend from the front edge of each of the agitator chambers to a pair of suction ports in the rear of the foot. The air passages extend laterally from the outward edge of the right and left agitator chambers to the centrally disposed gear box. The air passages form a path wherein particles deposited along a ledge adjacent the front edge of the cleaner foot are removed by the suction created by the suction motor-fan assembly located in the cleaner housing. The air passages direct the particles over the front and rear agitators to suction ports leading to the respective left and right suction conduits located along the right and left edges of the cleaner foot. The air passages confluently communicate with the front or forward suction ducts, if so equipped, disposed along the front edges of the right and left agitator chambers. The suction ducts serve to more evenly distribute nozzle suction along the front edges of the right and left agitator chambers to remove particles deposited on the ledge by the front agitator. Similarly, the rear suction ducts, if so equipped, uniformly distribute suction created by the motor-fan assembly transversely along the rear edges of the right and left agitator chambers to remove particles deposited by the rear agitator on a specially formed ledge along the rear edges of the agitator chambers. The suction ducts confluently communicate with the respective left and right suction conduits through the left and right suction ports.

The front suction ducts are partially formed by the front edge of the one-piece tunnel liner and the front sidewall of the agitator housing. The rear suction ducts are partially formed by a pair of channels formed in the agitator housing along the rear edges of the right and left agitator chambers. The front suction ducts for the suction nozzle are completed by a bottom plate which is mounted to the agitator housing and the foot main body. The bottom plate includes a rearwardly extending front lip that forms a part of the final bottom side of the suction nozzle. The rear suction ducts are completed by a ledge that extends forwardly from the front side of the foot main body which is attached to the rear stringer of the bottom plate. These front and rear ledges are vertically spaced from the bottom terminations of the duct cover, at their inner terminations to thereby permit the easy slot entrance of suction air, air entrained dirt, and agitator driven dirt into both the forward and rearward ducts.

In another aspect of the invention, a dirt collecting system is presented comprised partially of a translucent dirt cup re movably inserted into a recess in the vacuum cleaner housing. The dirt cup is sidewardly disposed in the recess. The recess is partially enclosed by an opaque curved sidewall having a curvilinear front edge. A portion of the recess is not enclosed and the and the dirt cup is visible from the area in front and the side of the cleaner. This allows a portion of the filter member inside the dirt cup to be seen as well as any dirt particles that may be inside the dirt cup to be seen in the area in front and to the side of the cleaner. A cutout portion in the curved sidewall allows another portion of the dirt collecting system and dirt cup to be visible in the are in front of the cleaner. This allows a portion of the filter member inside the translucent dirt cup to also be seen in the area in front of the cleaner. Dirt particles entering the dirt cup may also be seen in the area in front of the cleaner. A portion of a translucent filter cover on the front of the cleaner housing extends into the cutout portion.

The dirt cup is comprised of a dirt collecting chamber, a lid enclosing the dirt collecting chamber, a pre-filter and primary filter assembly slidably inserted in the dirt collecting chamber, a dirty air inlet fitting, and a handle on the side of the dirt cup for handling the dirt cup. The dirt cup is emptied by removing the dirt cup from the vacuum cleaner housing. The handle on the side of the dirt cup is provided for this purpose. While still grasping the handle, the dirt cup is emptied of debris by pulling the dirt cup handle sidewardly, removing the lid, and then inverting the dirt cup over a debris collection receptacle. The debris in the dirt cup will fall from the dirt cup into the debris collection receptacle. After emptying the dirt cup is returned upright, the lid is returned over the open top of the dirt cup. The dirt cup is then re-inserted into the vacuum cleaner housing. A nearly identical dirt collecting system is disclosed in U.S. Pat. No. 6,596,044 issued to Bilek et al., owned by a common assignee and incorporated by reference fully herein.

In an alternate embodiment of the this aspect of the invention, the dirt collecting system includes a translucent filtration bag container removably inserted into the vacuum cleaner housing. The filtration bag container is very similar to the aforementioned dirt cup in that it is sidewardly disposed and is inserted and removed from the housing in the same manner. The filtration bag container is comprised of a filtration bag chamber, a lid enclosing the filtration bag chamber, a filtration bag connector for connecting the filtration bag container to the dirty air inlet tube, and a handle on the side of the filtration bag container for handling the dirt cup. The filtration bag container is emptied by removing the filtration bag container from the vacuum cleaner housing. The handle on the side of the filtration bag container is provided for this purpose. While still grasping the handle, the filtration bag container is pulled sidewardly from the housing, the lid removed, and the filtration bag contained therein is discarded. A new filtration bag is inserted into the filtration bag chamber and the aperture of the collar of the filtration bag is inserted over the filtration bag fitting. The lid is then replaced and the filtration bag container is then re-inserted into the vacuum cleaner housing. When the bag container and filtration bag are inserted into the recess in the housing, a portion of the filtration bag and bag container may be seen through the cutout portion of the curved sidewall. Another portion of the filtration bag and bag container may be seen in the unenclosed portion of the recess.

In a second alternate embodiment of a dirt collecting system, because of the similarity between the dirt cup of the preferred embodiment and the filtration bag container of the first alternate embodiment, a single dirt container could be utilized by replacing the dirty air inlet fitting on the dirt cup with a filtration bag fitting utilized with the bag container option. The apertured wall and primary filter assembly may then be removed from the dirt container and a filtration bag may be inserted occupying the entire interior volume of the dirt container. Alternately, the apertured wall and primary filter may remain in the dirt container and a smaller filtration bag may be inserted in a portion of the dirt container adjacent the apertured wall. Alternately, the apertured wall and primary filter may remain in the dirt cup as the filtration media and no filtration bag is inserted therein.

Another aspect of the invention is an agitator and agitator drive configuration. The agitator configuration is comprised of a pair counter-rotating rotary agitators. Each agitator is comprised of a right and left agitator half section. The front right agitator is a right handed helix and the front left agitator is left handed helix. The opposing helix patterns sweep particles outward from the centrally disposed gear box to the sides of the of the suction nozzle so that the forward suction ducts can remove the particles from the forward ledges. Oppositely, the rear right agitator is a left handed helix and the rear left agitator is right handed helix. The opposing helix patterns sweep particles outward from the centrally disposed gear box to the sides of the suction nozzle so that the rearward suction ducts can remove the particles from the rear ledges. The agitator half-sections have a cross-section generally that of two trapezoidal sections stacked back to back and having an offset longitudinal axis. A plurality of brush members radially extend from the opposing radially outward ends of the trapezoid sections.

BRIEF DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
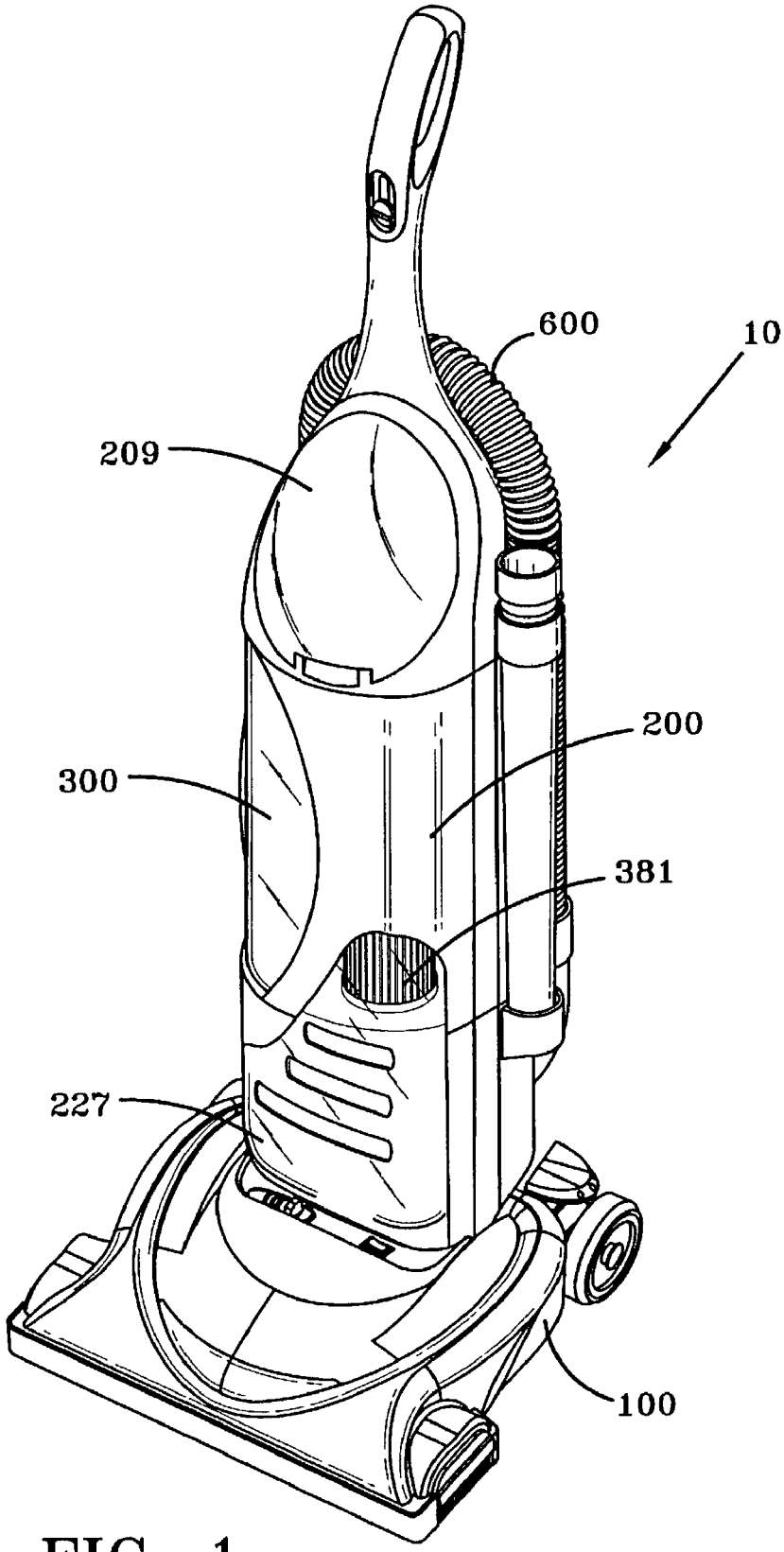
FIG. 1 is a left perspective view of the vacuum cleaner, according to the preferred embodiment of the present invention.
Figure 2:
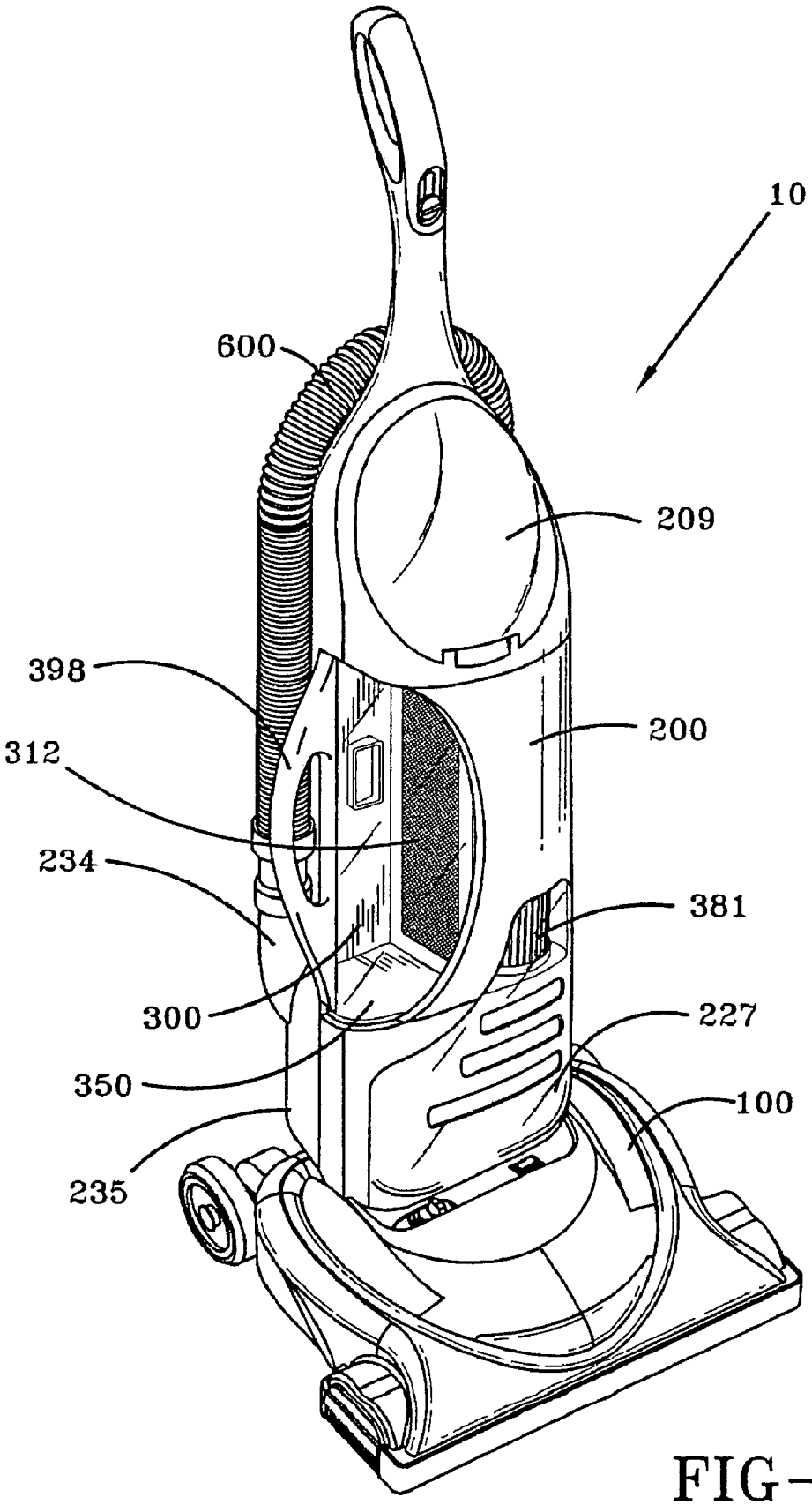
FIG. 2 is a right perspective view of the vacuum cleaner, according to the preferred embodiment of the present invention.
Figure 3:
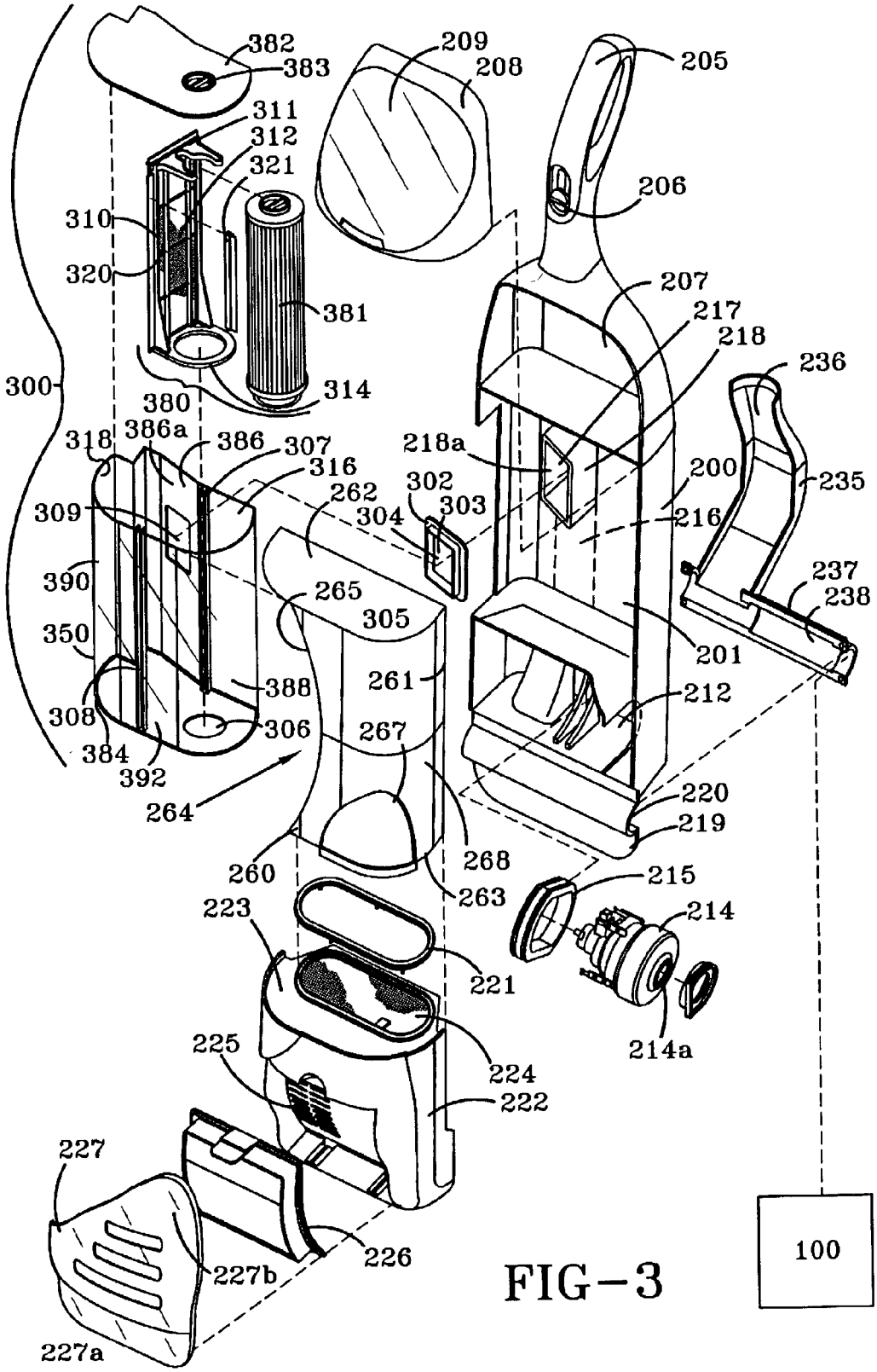
FIG. 3 is an exploded left perspective view of the upper housing of the vacuum cleaner of FIGS. 1 and 2 with the preferred embodiment of the dirt collecting system.
Figure 3A:
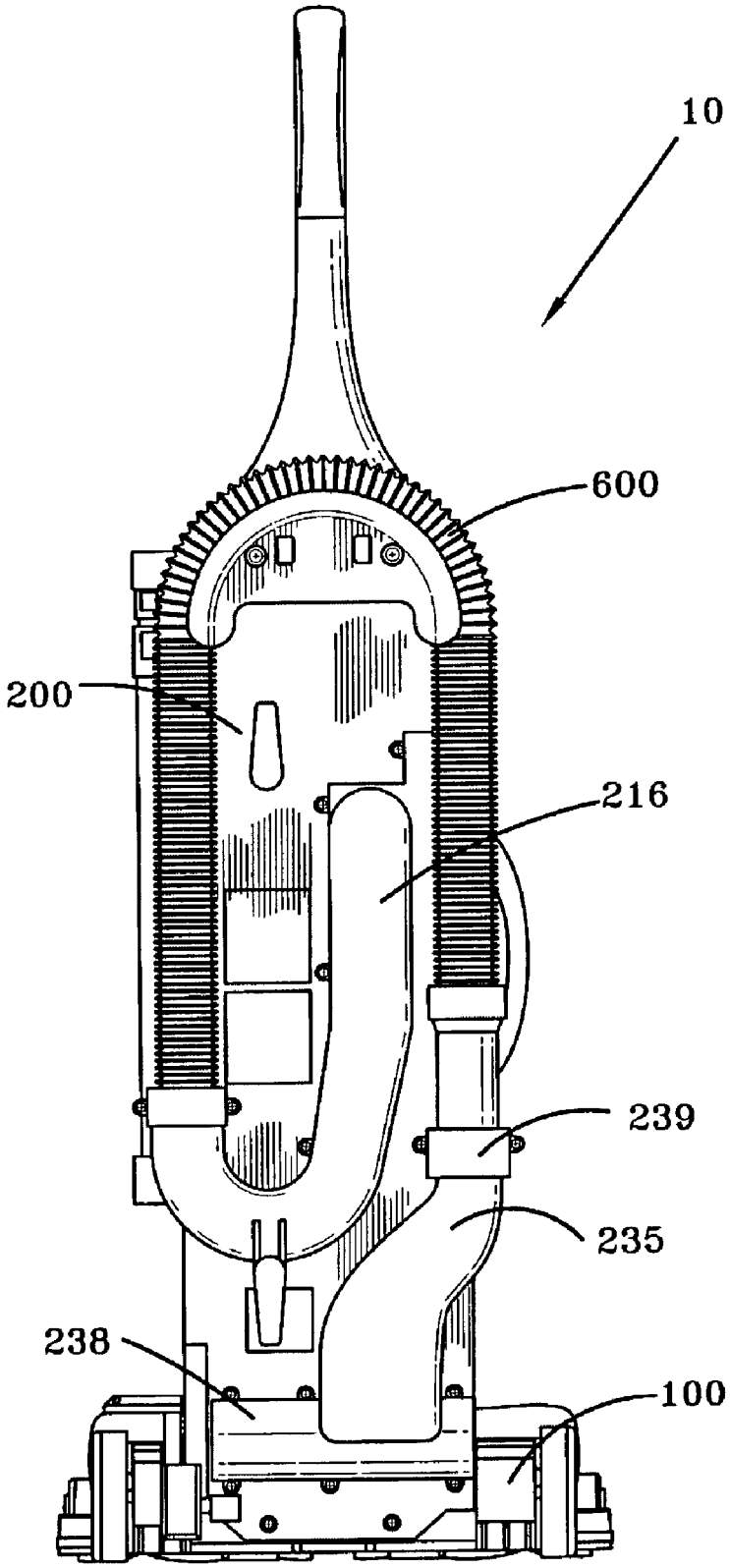

A vacuum cleaner incorporating one embodiment of a dirt collecting system 300 is shown in FIGS. 1–3 and is indicated generally at 10. Vacuum cleaner 10 includes a vacuum cleaner foot 100 and a vacuum cleaner handle or housing 200 connected to the vacuum cleaner foot or suction nozzle 100. A particle separating and collecting system 300 is sidewardly disposed in a recess 264 in the housing 200. The particle separating and collecting system 300 has a sidewardly extending handle 398 for removing the particle separating and collecting system 300 from recess 264. It is desirable to remove particle separating and collecting system 300 from recess 264 to dispose of particles collected therein and for cleaning of the filtration media also contained therein (described further hereinbelow). It is understood that although particle separating and collecting system 300 is inserted into recess 264 through an opening on the right side of the cleaner 10, particle separating and collecting system 300 could be inserted into recess 264 through an opening on the left side of the cleaner 10 without affecting the concept of the invention.

Referring specifically now to FIG. 3, a motor-fan assembly 214 having a suction inlet 214*a* is mounted in the lower portion of housing 200 in a recess 212 by a motor mount 215. Suction inlet 214*a* of motor-fan assembly 214 is fluidly connected to foot 100 by a suction duct 216 and an accessory hose 600 (FIGS. 1 and 2). It is understood that although motor-fan assembly 214 is shown positioned in the housing 200, the motor-fan assembly 214 could instead be positioned within foot 100 without affecting the concept of the invention.

Figure 11:
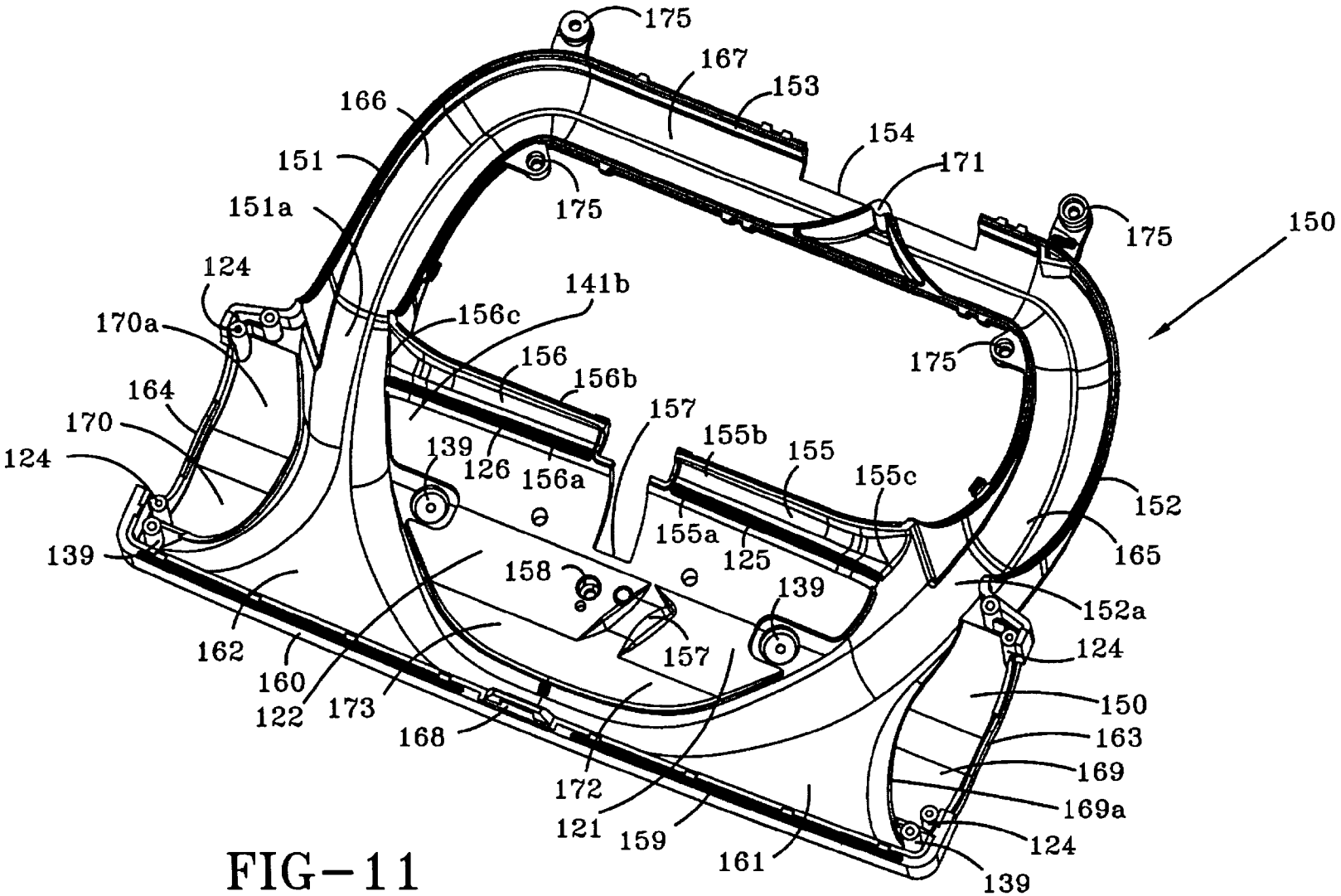
FIG. 11 is a rear elevated view of the agitator housing for the foot for the vacuum cleaner shown in FIGS. 1 and 2.

The housing 200 is pivotally connected to foot 100 with fluid communication being maintained therebetween by a rectangular duct 154 formed in the rear duct 167 of foot 100. The housing 200 is pivotally connected to foot 100 by a flange portion 219 having a semi-circular recess pivoting valve arrangement comprised of a pivoting duct cover 235 and a flange portion 219 of housing 200 clamping over the rear duct 167 of foot 100. Both flange portion 219 and pivoting duct cover 235 have a semi-circular recessed portion 220,238 for rotatably receiving rear duct 167. Pivoting duct cover 235 has a split tubular portion 237 wherein semi-circular recess 238 is formed thereon. Rear duct 167 is fluidly connected to both a right suction duct 165 and a left suction duct 166 on foot 100. Right suction duct 165 is fluidly connected to right agitator chamber 121 while left suction duct 166 is fluidly connected to left agitator chamber 122. The flow from right suction duct 165 and left suction converge together a rear duct 167 being directed out of rear duct 167 through a single exit opening or duct 154 by a flow diverter 171 located inside duct 167 (FIG. 11). Pivoting duct cover 235 has a channel portion 236 which clamps over an accessory hose adaptor (not shown) which allows an accessory hose 600 to be connected thereto. Accessory hose 600 is fluidly connected to dirt duct 216, dirt separation system 300, and suction inlet 214*a* of motor-fan assembly 214. Connection of the accessory hose 600 to the accessory hose adaptor (not shown) connects the suction created by the motor-fan assembly 214 to rear duct 167, left and right suction ducts 165,166, and agitator chambers 121,122, or alternately, to off-the-floor accessory tools that are stored in an accessory tool recess 207 formed in housing 200. Accessory tool recess is covered by a tool storage recess cover 208 and a tool storage door 209 allowing access to the accessory tools stored therein.

The suction from suction inlet opening 214*a* of motor-fan assmebly 214 is directed through passages in recess 212 to an intake opening 224 formed in the bottom of housing 200. Intake opening 224 is fluidly connected to the bottom of dirt collecting system 300 via a clean air outlet opening 306 when dirt collecting system 300 is inserted into housing 200. Dirt collecting system 300 is also fluidly connected to agitator chambers 121,122 and nozzle opening 120 by a suction duct 216 and accessory hose 600 as previously described and described further hereinbelow. The suction airstream draws the loosened dirt and/or particles from the floor surface into nozzle opening 120 carrying dirt and/or other particles from agitator chambers 121,122 through accessory hose 600 and dirt duct 216 to dirt separation system 300 for particle separation and collection. After exiting dirt separation system 300, the now clean air is drawn into suction inlet 214*a* of motor-fan assembly 214 and exhausted. The air exhausted from motor-fan assembly is directed through a plurality of ports 225 formed in a motor cover 222 to a final filter 226. The final filter 226 is enclosed by a filter cover 227 which has a series of slits 227*a* formed therein to allow the cleaned air to exit to the atmosphere. The final filter 226 may be a "HEPA" rated filter or other filtration media.

Referring specifically to FIG. 3, a front panel 260 partially encloses a recess 201 formed in the upper portion of housing 200. Front panel 260 is formed from an opaque top wall 262 and an opaque curved sidewall 268 to partially enclose recess 201 for receiving and supporting the dirt collecting system 300, as described below. Curved sidewall 268 has a curvilinear front edge 265 that extends from the top wall 262 to its bottom edge 263 so that a portion of front of dirt collecting systems 300 or 400 are visible from the front and side of the cleaner 10. Front panel 260 further has a cutout portion 267 so that a portion of dirt collecting systems 300 or 400 may be seen from the region in front of cleaner 10. A portion 227*a* of translucent filter cover 227 extends into cutout portion 267 so that the portion of dirt collecting system 300 or dirt collecting system 400 (described below) may be seen. The bottom wall 384 of dirt cup 350 or the bottom wall 484 of bag container 450 engages a seal 221 surrounding the periphery of intake opening 224 so that suction from the suction inlet opening 214*a* of motor-fan assembly 114 is directed through the respective clean air outlet openings 306, 466 in dirt cup 350 or bag container 450.

The preferred embodiment of the present dirt collecting system is shown in FIG. 3 and generally includes a translucent dirt cup 350, a filter assembly 380 removably mounted within the dirt cup 350 and a dirt cup lid 382 which encloses the dirt cup 350. The dirt cup 350 includes a bottom wall 384, a generally flat rear wall 386, a pair of curved side walls 388 and 390, and a front wall 392. Rear wall 386, side walls 388 and 390 and front wall 392 extend upwardly from the bottom wall 384 to form a dirt cup chamber 394. Front wall 392 curves inwardly from each sidewall meeting at the center. Rear wall 386 has a flat, slightly angled portion 386*a* so that the seal 302 of dirty air inlet aperture 309 formed therein mates with a likewise angled face of suction duct connector 218 of suction duct 216. A handle 398 is located on the side wall 390 extending sidewardly therefrom. A clean air exhaust port 306 is formed in the bottom wall 384 of dirt cup 350 which fluidly connects dirt cup 350 to intake port 224. A front guide rib 308 extends inwardly from the front wall 392 of the dirt cup 350, and a rear guide rib 307 extends inwardly from the rear wall 386 of the dirt cup 350. A partition wall 310 extends upwardly from the bottom wall 384 of the dirt cup 350. Partition wall 310 extends between the front wall 392 and the rear wall 386 of the dirt cup and includes a top edge 311 which sits approximately ¾ inches above the bottom wall 384. In the present embodiment, the dirt cup is a one-piece member molded of ABS and includes an anti-static additive to prevent dirt from electro-statically adhering to the walls of the dirt cup. However, it is understood that the dirt cup may be formed of any number of suitable materials, and particularly plastic materials, without affecting the concept of the invention.

Still referring to FIG. 3, the filter assembly 380 generally includes an apertured wall 312, a filter support 314 extending from the apertured wall 312 and a primary filter member 381 which removably mounts on the filter support 314. The filter assembly 380, and particularly the apertured wall 312 thereof, along with the partition wall 310 separate the dirt cup chamber 394 into a first dirt collecting chamber 316 and a second dirt collecting chamber 318. The apertured wall 312 is positioned between rear wall 386 and front wall 392 and is formed with a plurality of apertures or holes 320. The holes 320 provide for fluid communication between the first dirt collecting chamber 316 and the second dirt collecting chamber 318.

The apertured wall 312 functions as a coarse particle separator or pre-filter and could include any numberof holes having various shapes (circular, square, elliptical, etc.), sizes and angles. To maximize airflow through the holes while still preventing large debris from passing therethrough, it is desirable to form the holes as large as 0.0036 square inches and as small as a 600 mesh screen. In the present embodiment, the holes 312 are circular with a hole diameter of approximately 0.030 inches. Further, the apertured wall should be formed with enough total opening area to maintain airflow through the dirt cup. It is desirable to form apertured wall 312 with a total opening area of between approximately 2.5 square inches to approximately 4 square inches.

In the present embodiment, there are approximately 196 holes/inch$^2$ with the holes 320 form a total opening area of approximately 3.2 square inches. In the present embodiment, the apertured wall 312 is a one-piece member integrally molded of a plastic material, such as a polypropylene and may include an anti-static additive to prevent dirt from electro-statically adhering thereto. However, it is understood that the apertured wall may be formed of a number of different materials such as metal or synthetic mesh or screens, cloth, foam, a high-density polyethylene material, apertured molded plastic or metal, or any other woven, non-woven, natural or synthetic coarse filtration materials without affecting the concept of the invention. Primary filter member 381 is rotatably mounted to partition wall 310 and filter support member 314 so that primary filter 381 may be rotated against flexible wiper member 321 by knob 384 embedded in lid 382 to knock accumulated dust and particles from primary filter 381. A nearly identical dirt collecting system is disclosed in U.S. Pat. No. 6,596,044 issued to Bilek et al. and U.S. Pat. No. 6,598,263 issued to Boles et al., both of which owned by a common assignee and incorporated by reference fully herein.

Figure 4:
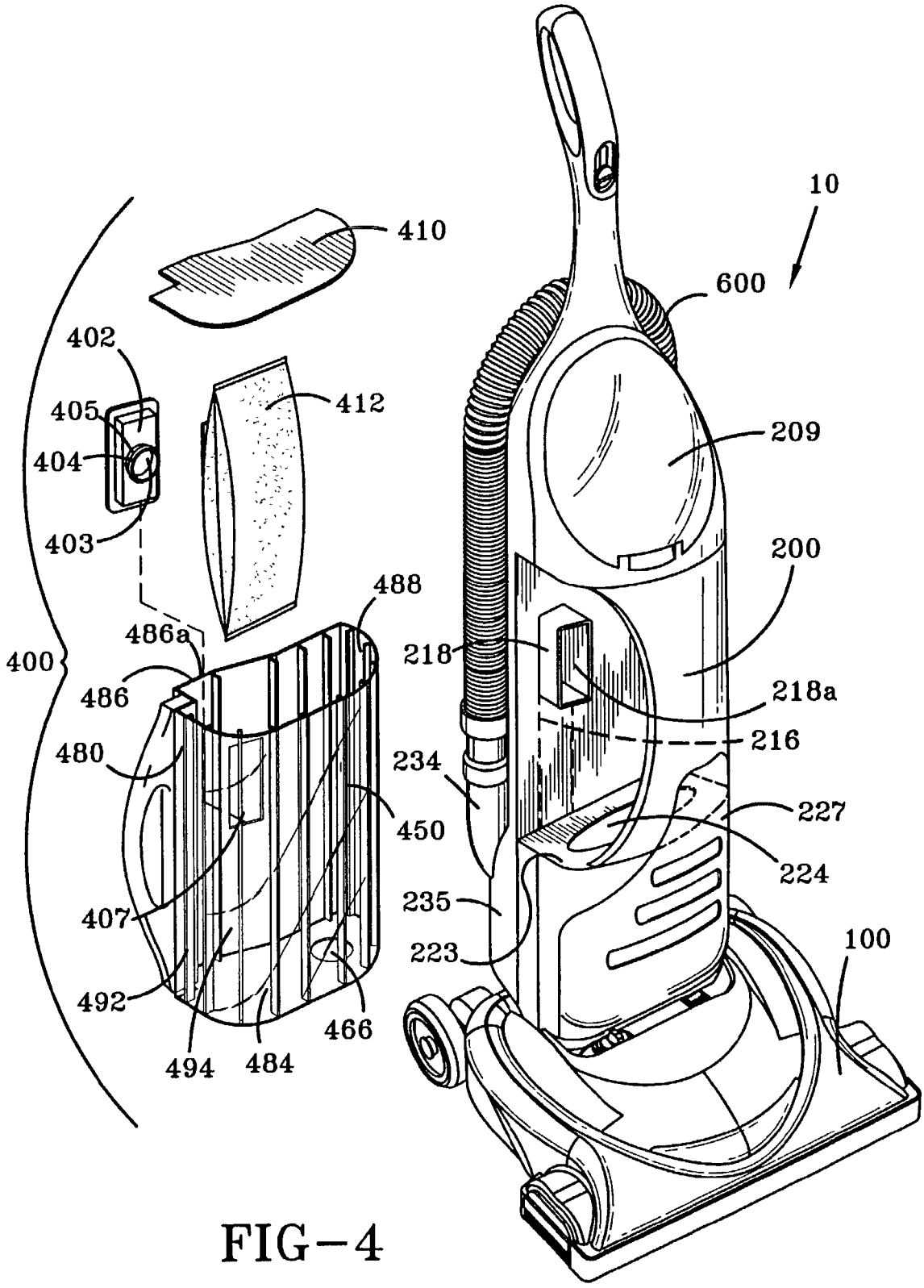
FIG. 4 is right perspective view of the vacuum cleaner of FIGS. 1 and 2 with an alternate embodiment dirt collecting system removed from the housing and shown exploded.
Figure 5:
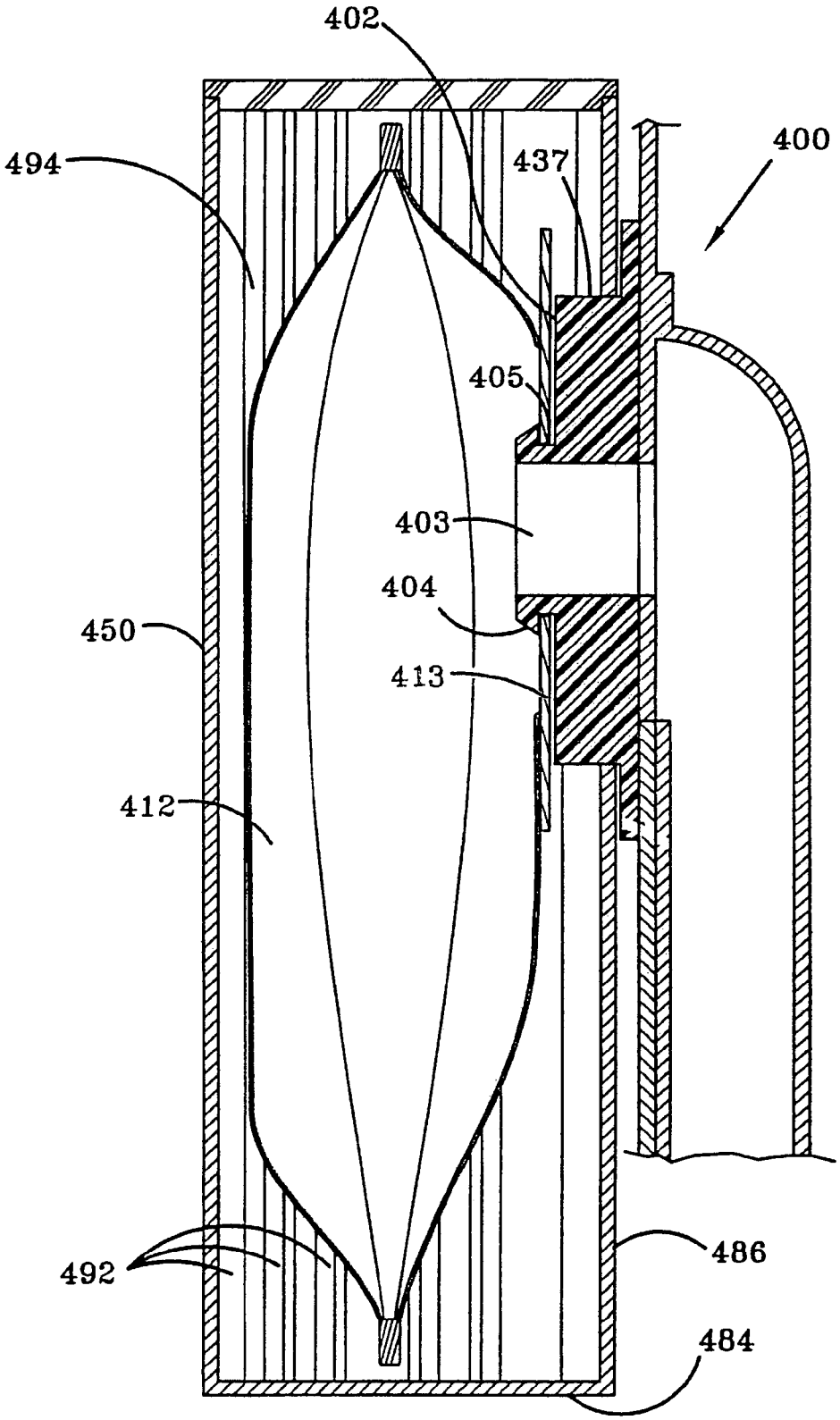
FIG. 5 is a cross-sectional side view of the alternate embodiment dirt collecting system shown exploded in FIG. 4.

An alternate embodiment of a dirt collecting system, hereinafter designated as dirt collecting system 400, may be substituted as shown in FIG. 4 wherein dirt cup 350 is replaced with a translucent filtration bag container 450. Filtration bag container 450 is comprised of a rear wall 486, bottom wall 484 and right and left curved sidewalls 488,490. A filtration bag 412 is placed inside the chamber 494 of bag container 450. Suction from motor-fan assembly 214 drawn through clean air outlet opening 266 creates negative pressure inside chamber 494 causing the dirt laden airstream from agitator chambers 121,122 to be drawn into filtration bag 412. The sidewalls of filtration bag 412 prevent particles from entering chamber 494. Particles are collected inside filtration bag 412 for collection and later disposal. Filtration bag 412 is held securely within chamber 494 by the filtration bag collar 413 (FIG. 5) attached to one side of filtration bag 412. An aperture (not shown) through collar 413 allows fluid communication with an inlet aperture 403 in a filtration bag connector 402 connected to the sidewall of filtration bag container 450. As seen in FIG. 5, the aperture [411] fits snugly over an annular ring 404 and held securely by an annular groove 405 on the inward side of filtration bag connector 402. Alternately, filtration bag 412 may utilize other means to fluidly connect to filtration bag connector 402 including but not limited to a rotating locking collar, a collar and a spring clip arrangement, a throw away bag changer, or a slide in collar. The filtration bag 412 may also be installed in a cassette carrier (not shown) before being inserted into bag container 450. Filtration bag connector 402 is fitted into rectangular opening 486 in the rear wall 486 of filtration bag container 450. Filtration bag connector 402 provides a fluid tight connection between an inlet aperture 411 (not shown) of filtration bag 412 and dirty air inlet connector 218 of suction duct 217. A lid 404 seals chamber 494 from the atmosphere. Filtration bag 412 is an ordinary filtration type bag commonly in use in vacuum cleaners or it may be a "HEPA" rated filtration bag which could be made from one or more layers of expanded polytetrafluoroethylene (ePTFE). Such a filtration bag is described and disclosed in Hoover Case 2577, Ser. No. 10/067,186.

Figure 4A:
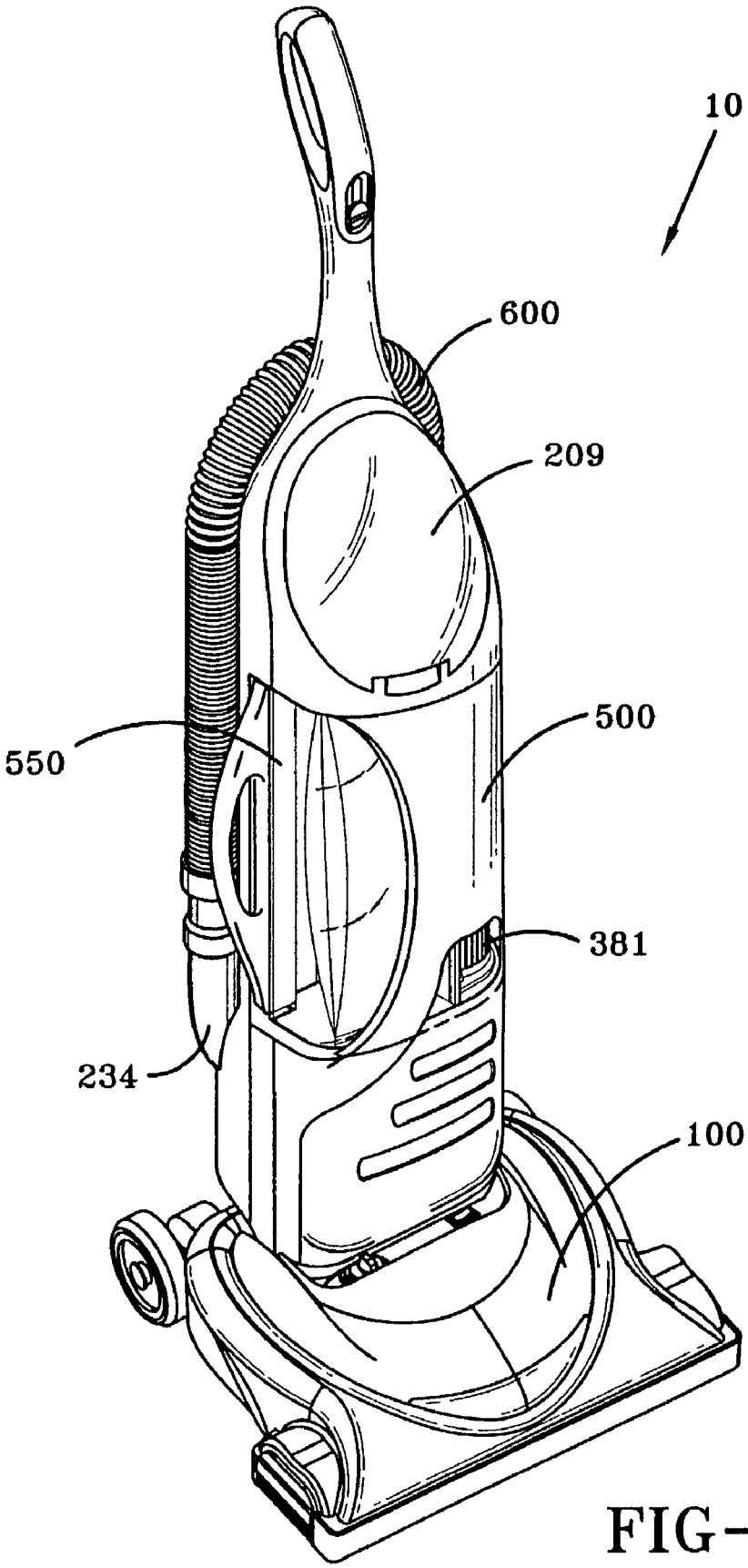
FIG. 4*a* is a right perspective view of the vacuum cleaner with a second alternate embodiment of a dirt collecting system.
Figure 4B:
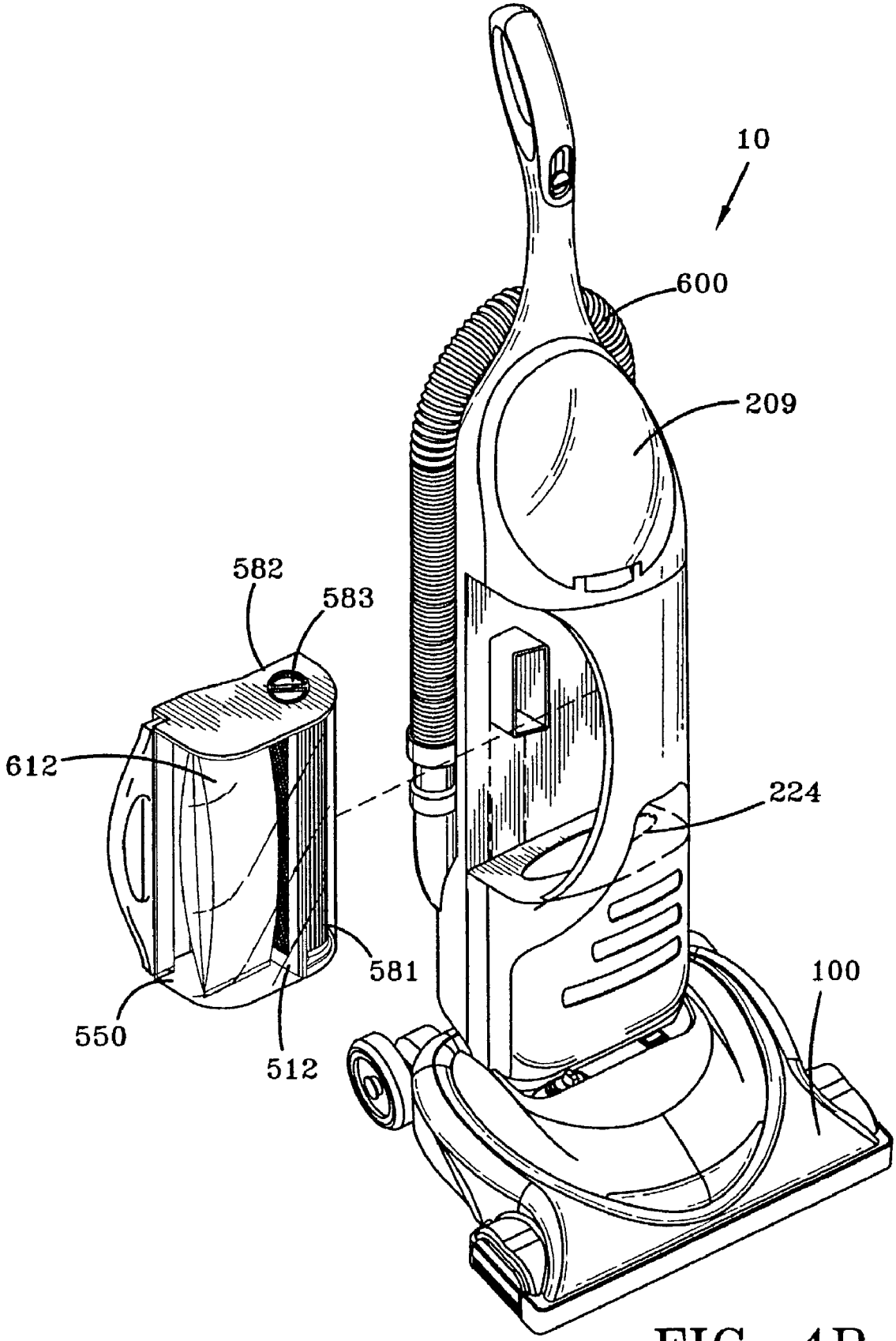
FIG. 4*b* is a right perspective view of the vacuum cleaner in FIGS. 1 and 2 with the second alternate embodiment of the dirt collecting system of FIG. 4*a* removed from the housing.
Figure 4C:
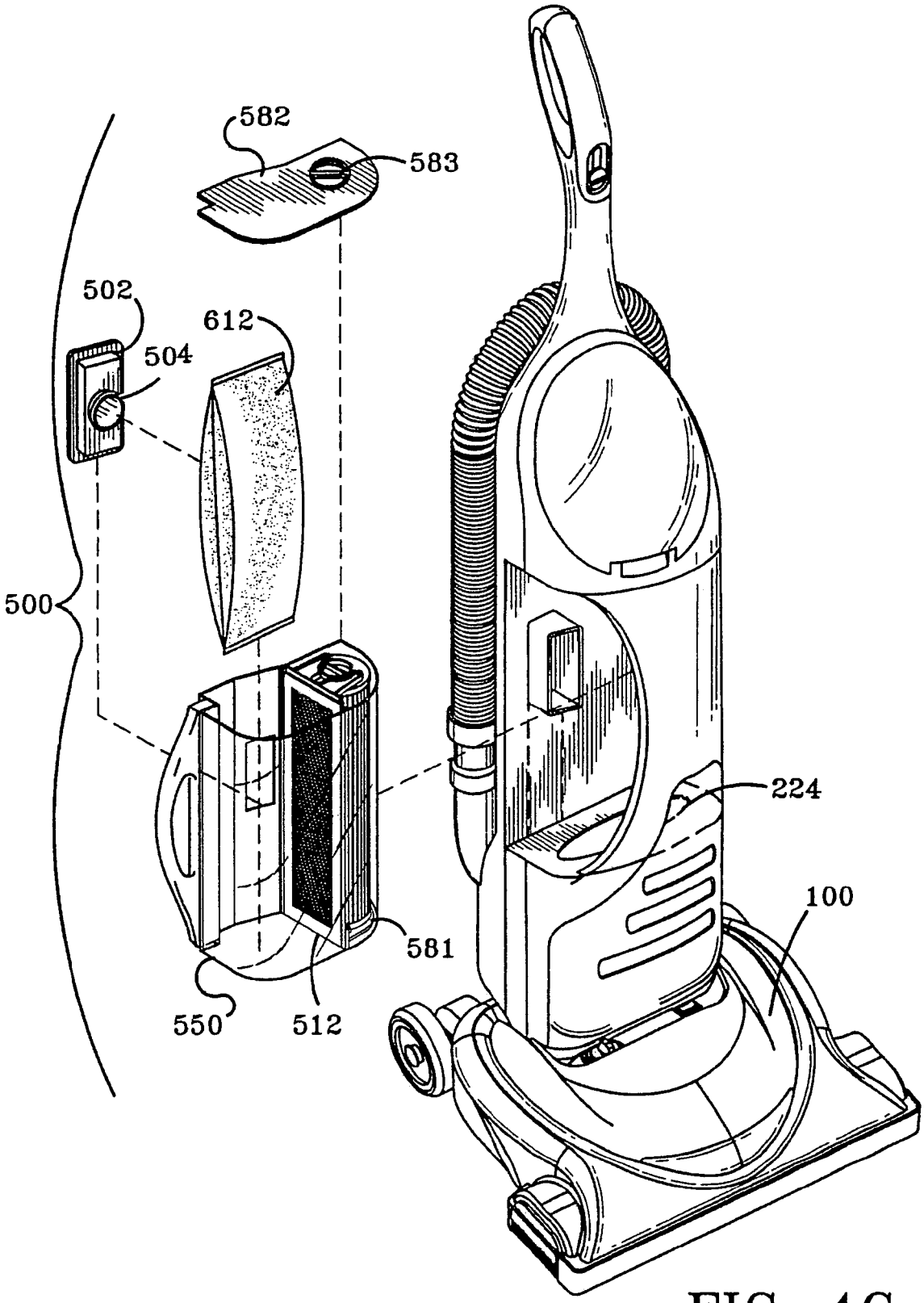
FIG. 4*c* is an exploded view of the second alternate embodiment of the dirt collecting system of FIG. 4*a* removed from the housing.

Referring now to FIGS. 4*a*–4*c*, a second alternate embodiment dirt collecting system 500 is provided wherein a single dirt container 550 replaces dirt cup 350 of the preferred embodiment dirt collecting system 300 and the bag container 450 of the first alternate embodiment dirt collecting system 400. The single dirt container 550 would be substantially the same as dirt cup 350 of the preferred embodiment dirt collecting system 300 but would be equipped with a filtration bag connector 502 like filtration bag connector 402 shown in FIG. 4. With such an arrangement, dirt collecting system 500 may be equipped with filtration bag 412 only which occupies the entire interior volume of dirt container 550.

In a first alternate embodiment of dirt collecting system 500, and referring specifically now to FIG. 4*c*, a smaller filtration bag 612 may be fitted inside a first dirt collecting chamber 516 while a primary filter member 581 remains inside a second chamber 518. An apertured wall 512 divides the interior volume of dirt container 550 into the first dirt collecting chamber 516 and the second chamber 518 while filtering and preventing large particles from entering second chamber 518 from first dirt collecting chamber 516. Filtration bag 612 may be of the type having a cardboard collar fitting over the annular ring 504 of a filtration bag connector 502 or the other connection means discussed.

In a second alternate embodiment of dirt collecting system 500, no filtration bag is inserted in first dirt collecting chamber 516 of dirt container 550 while apertured wall 512 remains intact for filtering large particles and primary filter 581 remains intact inside the second chamber 518 for filtering small particles.

In yet another alternate embodiment of the dirt collecting system 500, any of the aforementioned embodiments of dirt collecting system 400 and dirt collecting system 500 shown in FIG. 4 and FIGS. 4*a*–4*c* may have a plurality of ribs such as for example ribs 492 on the inner sidewall of bag container 450 to give the sidewall strength and to support filtration bag 412 or filtration bag 612 contained therein, if so equipped. The plurality of vertical ribs may be located in dirt container 550 in the first dirt collecting chamber 516 or both the first dirt collecting chamber 516 and the second chamber 518 to support a larger size filtration bag such as filtration bag 412 or a smaller size filtration bag such as filtration bag 612 and strengthen the sidewall of the bag container 450.

Note that both the preferred embodiment of a dirt collecting system 300 and the alternate embodiment dirt collecting system 400 are shown being installed in recess 201 in a left sidewardly disposed manner through a leftward facing opening. Both the preferred embodiment of a dirt collecting system 300 and the alternate embodiment dirt collecting system 400 could be installed in recess 201 in a right sidewardly disposed manner through a rightward facing opening. The second alternate embodiment dirt collecting system 500 may be disposed likewise.

Figure 6:
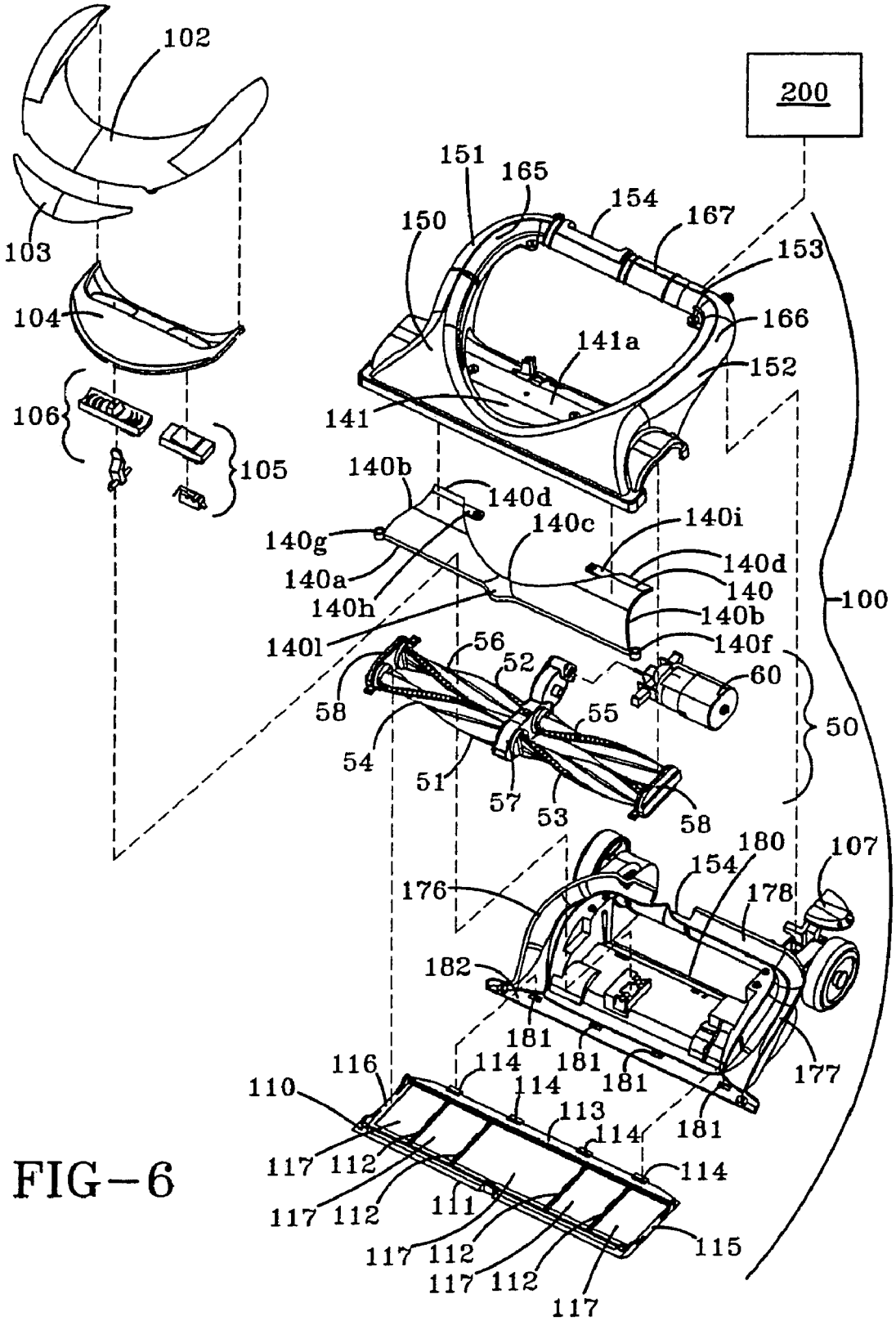
FIG. 6 is an exploded view of a vacuum cleaner foot for the vacuum cleaner shown in FIGS. 1 and 2.

Referring now to FIG. 6, shown is an exploded view of a vacuum cleaner suction nozzle or foot 100. The vacuum cleaner foot is partially formed from an agitator housing 150 and a cleaner foot main body 180. The foot 100 is formed with a bottom nozzle opening 120 (FIG. 14) which opens towards a floor surface. A pair of rotary agitators 51,52 are positioned in symmetric left and right agitator chambers 121,122 disposed within the bottom nozzle opening wherein each of the rotary agitators 51,52 is comprised of a right and left agitator half section. One of the rotary agitators, hereinafter front agitator 51, is disposed adjacent the front edge of the suction nozzle 100. Front agitator 51 is comprised of front right agitator half-section 54 and front left agitator half-section 53. Front right agitator half-section 54 is located inside right agitator chamber 121 while left front agitator half-section 53 is located in left agitator chamber 122.

The other rotary agitator, hereinafter rear agitator 52, is disposed adjacent the rear edges of the suction nozzle. The rear right agitator half-section 56 is located inside right agitator chamber 121 while rear left agitator half-section 55 is located in left agitator chamber 122. The pair of rotary agitators 51,52 rotate about horizontal axes Ax, Bx (FIG. 15) for loosening dirt from the floor surface.

Figure 7:
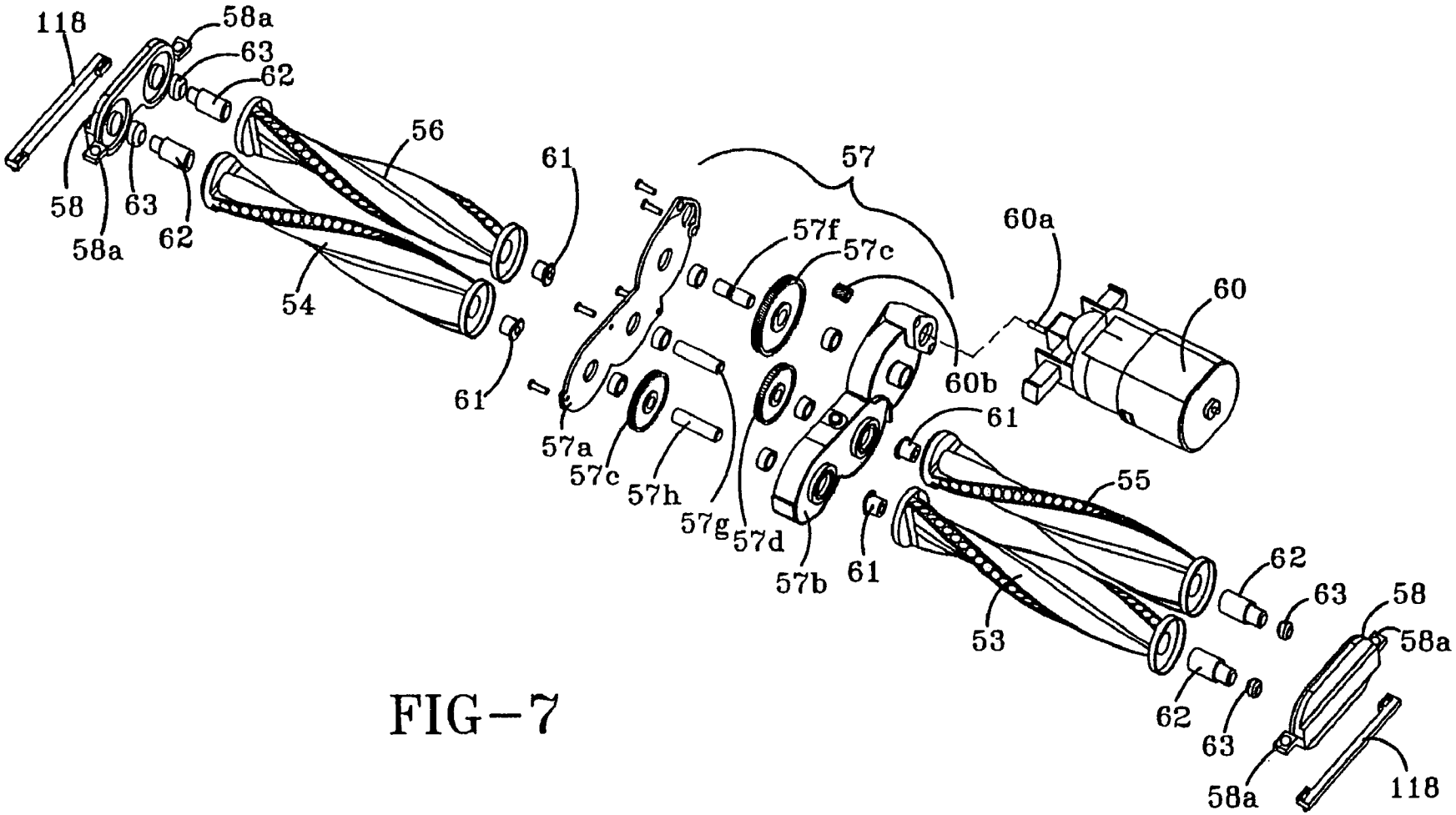
FIG. 7 is an exploded view of an agitator configuration and agitator drive assembly shown in FIG. 6.
Figure 8:
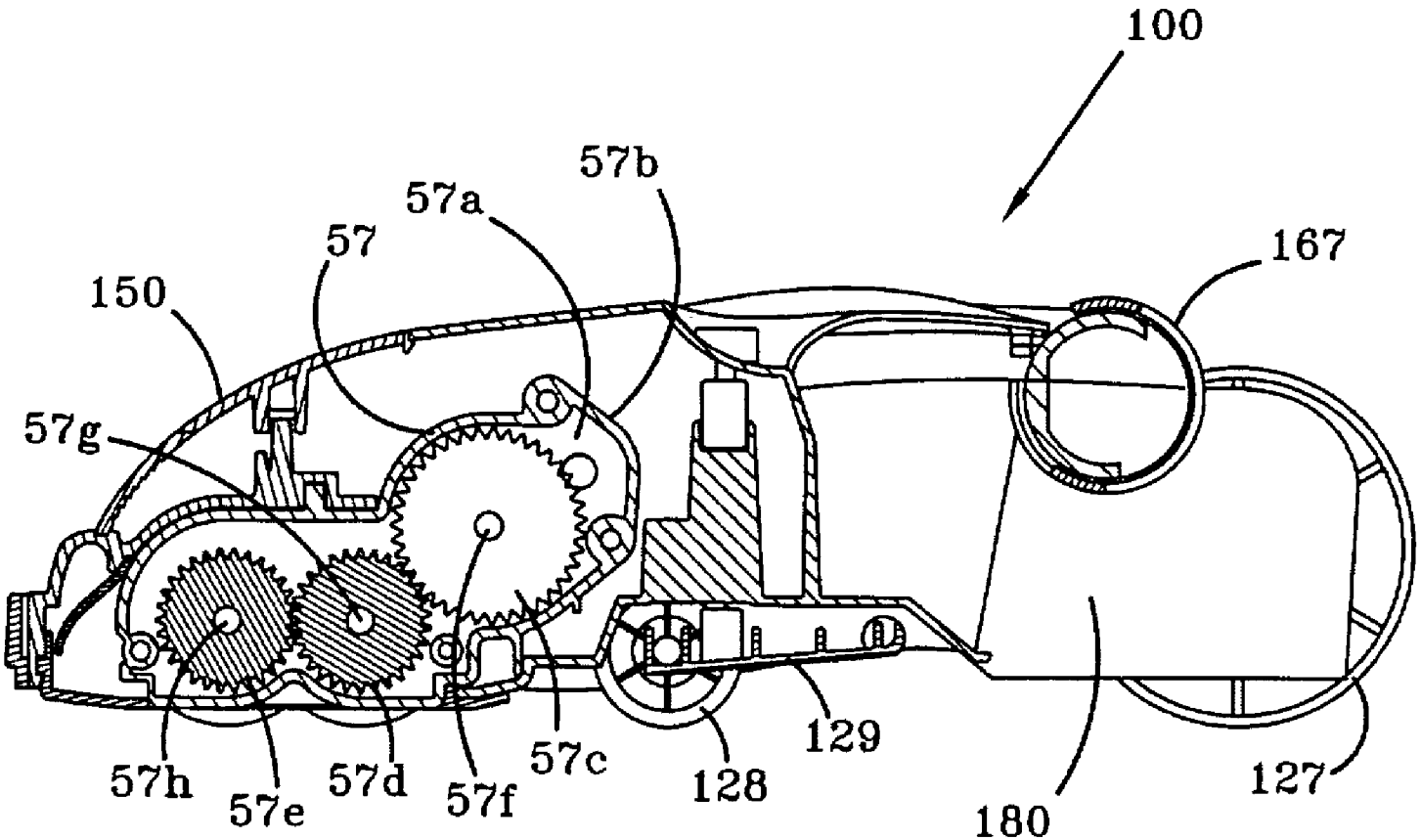
FIG. 8 is a cross-sectional view of the foot for the vacuum cleaner shown in FIGS. 1 and 2 taken along line 8—8 of FIG. 9 showing the gear configuration of the agitator drive assembly.
Figure 9:
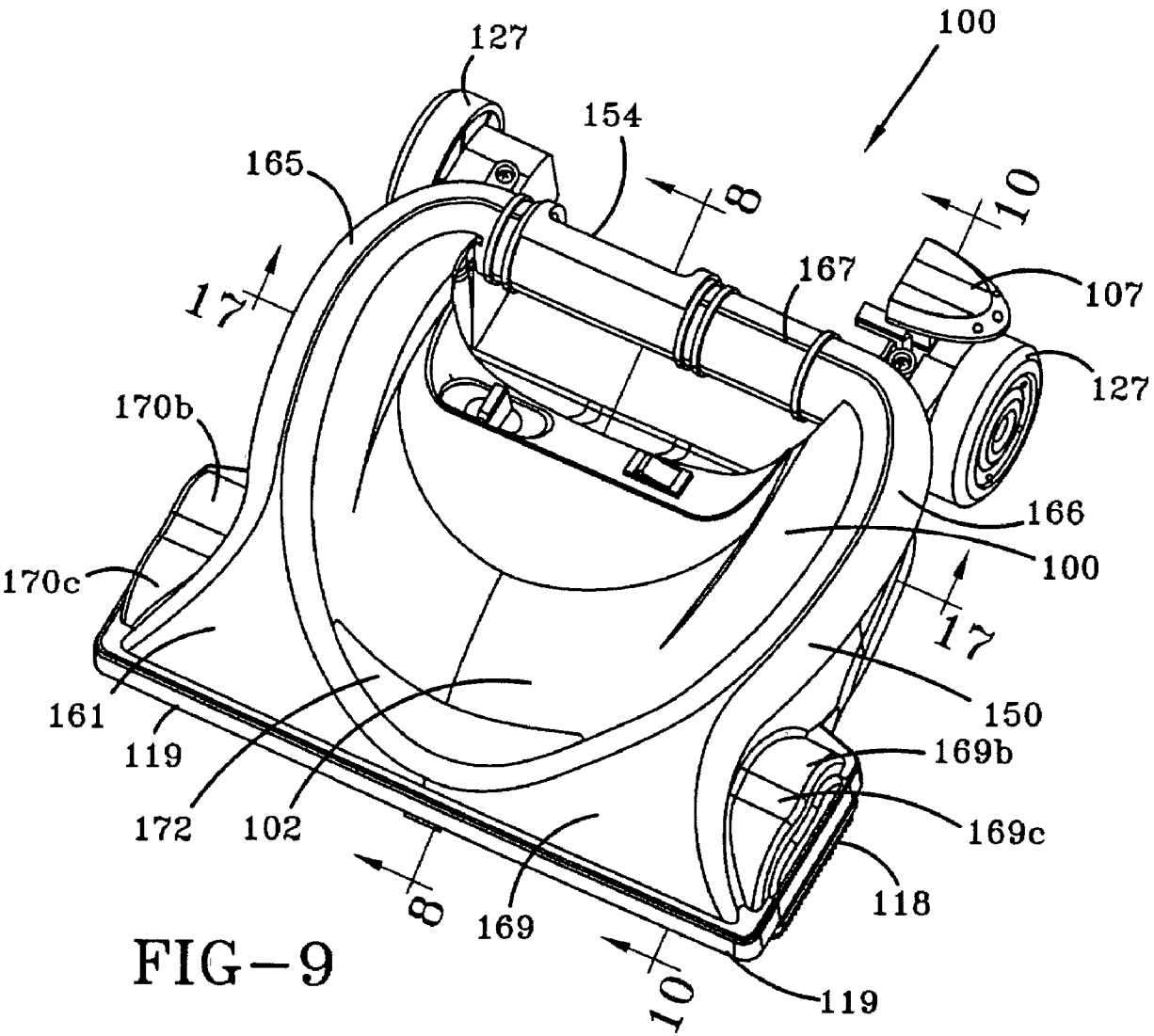
FIG. 9 is an elevated perspective view of the vacuum cleaner foot shown in FIG. 6.

The agitator drive assembly shown in FIGS. 6 through 8 consists of a front and rear agitator 51,52 each comprised of two agitator half-sections 54,56 and 53,55. The agitator half sections 54,56 and 53,55 are driven by a common central gear box 57 providing rotary power to a front drive shaft 57*h* and a rear drive shaft 57*g*. The front agitator half-sections 53,54 are driven by the front agitator drive shaft 57*h* and the rear agitator half-sections are driven by a rear gear shaft 57*g*. The rotary power is transmitted to the agitator half sections 53,54,55,56 by agitator inserts 61,61,61,61 that are keyed and designed to fit into a complementary recess (not shown) in the inward end of each agitator half-section. A hollow interior of each agitator insert 61,61,61,61 is pressed onto the respective drive shaft 57*g*, 57*h* and is non-rotatably held thereon in a semi-interference type fit. Alternately, a pin could be inserted through the sidewall of each agitator insert 61,61,61,61 and through the drive shaft to prevent rotation relative to one another. In an alternate embodiment of the present invention, the agitator half-sections 53, 54, 55, 56 could be driven on the inward end by a helical gear assembly similar to the one shown in U.S. Pat. No. 1,891,504 issued to Smellie, and incorporated by reference fully herein. In another alternate embodiment of the present invention, agitator half-sections 53,54,55, 56 could be driven on the inward or outward ends by a belt arrangement coupled to an independent drive motor or to the motor-fan assembly as is well known in the art.

Each agitator half section 53,54,55,56 consists of a helical ribbon that extends 180° from the inward end to an outward end. The outward ends of each agitator half section 53,54, 55,56 is supported by a stub shaft 62,62,62,62 press fitted into a recess (not shown) on the outward end. Stub shafts 62,62,62,62 are rotatably supported by a spherical bearing 63,63,63,63 located in end caps 58,58 attached to the inner wall on the outward side of each agitator chambers 121,122. A plurality of brushes 50 consisting of an approximately equal plurality of bristles extend radially outward from the ribbon portion of each agitator half-section 53,54,55,56.

The front and rear drive shafts 57*h*,57*g* are geared to drive the front and rear agitator half-sections 53,54 and 55,56 in a counter-rotating direction. As viewed from the left side of the cleaner, the front agitator half sections 53,54 are driven clockwise and the rear agitator half-sections 55,56 are driven counter-clockwise. The front drive shaft 57*h* is driven by a front gear 57*e* which is rotatably driven by a rear gear 57*d*. The rear gear 57*d* also drives the rear drive shaft 57*g*. The rear gear 57*d* is rotatably driven by an idler gear 57*c*. The idler gear 57*c* transmits the rotary power of a pinion gear

60*a* driven by the drive shaft 60*b* of an independent electric motor 60. The idler gear 57*c* also serves to convert the higher RPM, lower torque of the independent drive motor 60 to a lower RPM, higher torque required by the front and rear agitator assemblies 51, 52.

Figure 10:
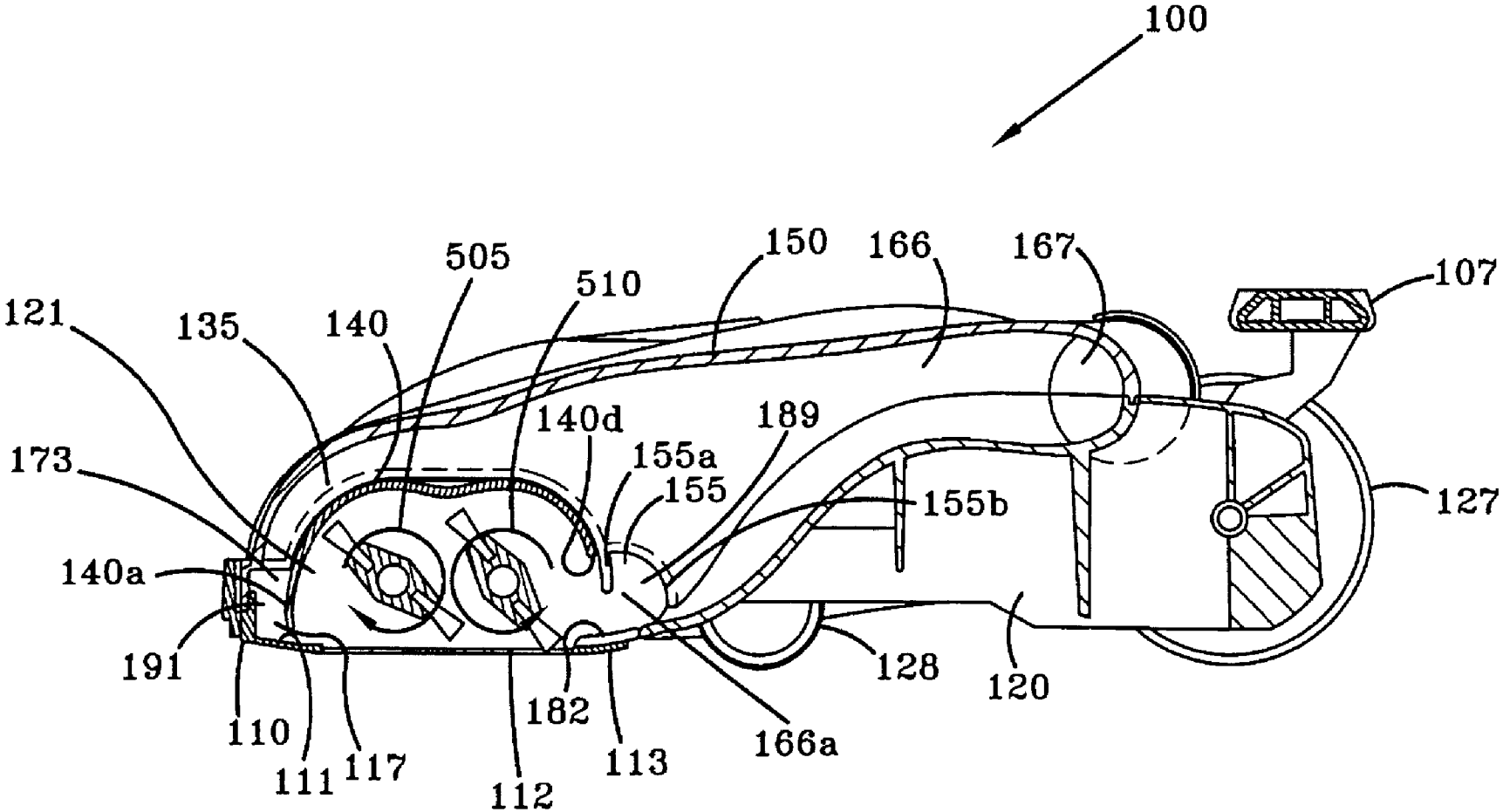
FIG. 10 is a partial cross-sectional view of the foot for the vacuum cleaner in FIGS. 1 and 2 taken along line 10—10 of FIG. 9.

The front right agitator 54 consists of a right handed helical ribbon that turns 180° from the inward end to the outward end. The front left agitator 53 consists of a left handed helical ribbon that turns 180° from the inward end to the outward end. The brush members 50 on the inward ends of front right agitator 54 front left agitator 53 are aligned with one another so that a "chevron" pattern is formed by the brush members 50 extending from the helical ribbon portions of the agitator half sections 54,53. Brush members 50 are arranged on front right agitator 54 in a right-handed helical pattern and in a left-handed helical pattern on front left agitator 53 so that particles are swept outward from the protruding portion 140*d* of nozzle liner 140 (FIG. 12) to the bosses 139 on the right and left outward ends of agitator housing 150 (FIG. 12) as the front right and the front left agitator half-sections 53,54 rotate in the clockwise direction (FIG. 10). The rear right agitator half-section 56 consists of a left-handed helical ribbon that turns 180°° from the inward end to the outward end. The rear left agitator half-section 55 consists of a right-handed helical ribbon that turns 180° from the inward end to the outward end. The brush members 50 on the inward ends of rear right agitator 56 and rear left agitator 55 are aligned with one another so that a "chevron" pattern is formed by the brush members 50 extending from the helical ribbon portions of the agitator half sections 56,55. Brush members 50 are arranged on rear right agitator 56 in a left handed helical pattern and in a right handed helical pattern on rear left agitator half-section 55 so that particles are swept outward from gear box 57 to channels 161,162 (FIG. 11), respectively, as the rear right and the rear left agitator half-sections 55,56 rotate in the counter-clockwise direction (FIG. 10). The plurality of bristles 50 of the front agitator half sections 53,54 are arranged to intermesh with the rear agitator half-sections 55,56. In an alternate embodiment of the present invention, the front agitator half sections 53,54 are spaced further apart from the rear agitator half-sections 55,56 so that the plurality of brushes 50 are not intermeshed. The front agitator half-sections 53,54 and the rear agitator half-sections 55,56 rotate in the same clockwise direction, as viewed from the left side of the cleaner 10. Alternately, the front agitator half-sections 53,54 and the rear agitator half-sections 55,56 could rotate in the same counter-clockwise direction, as viewed from the left side of the cleaner 10.

Figure 7A:
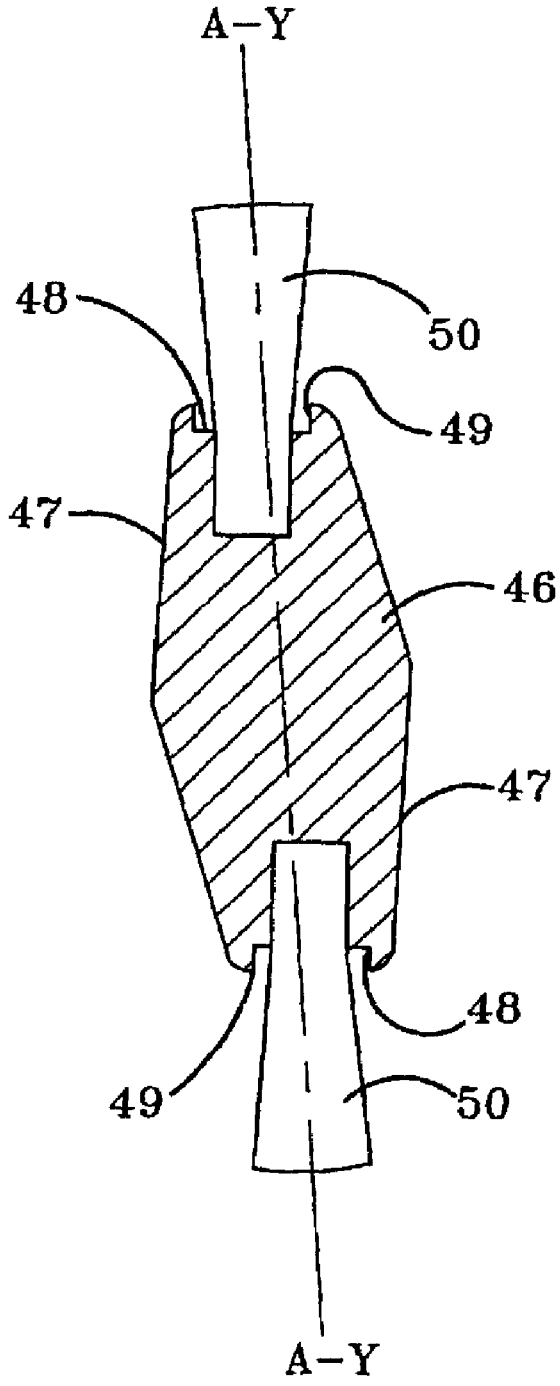
FIG. 7*a* is a cross-sectional view of one of a plurality of agitator half-sections shown in the agitator configuration shown in FIG. 7.

The cross section of each of the agitator half-sections 53,54,55,56 is shown in FIG. 7*a* The cross-section is comprised generally of two trapezoidal half-sections forming the ribbon portions 47,47 stacked on top of another having an offset longitudinal axis Ay. A channel 48 is formed on each of the outward radial ends 49,49 for receiving the plurality of brush members 50.

Another aspect of the invention is shown in FIG. 6 and in detail in FIGS. 9–18. Referring specifically to FIG. 6, shown is a vacuum cleaner foot 100 (or alternately referred to as suction nozzle 100) having a rather extensive agitator chamber housing 150 surrounded by a hood 102 and a control panel portion 104. Agitator chamber housing 150 is transparent except as described below. The hood 102 and a lens cover 103 are fitted into a recessed medial portion 141 formed on the front and upper side of agitator chamber housing 150. The recessed medial portion 141 has a semi-cylindrical shaped bottom wall 141*a* separating recessed medial portion 141 from the downwardly disposed nozzle opening 120 located below. Bottom wall 141*a* is also partially forms the top wall of nozzle opening 120. A lamp assembly (not shown) may be installed on the upper surface of semi-cylindrical shaped bottom wall 141*a*. Hood 102 and lens cover 103 when fitted into recessed medial portion 140 enclose the lamp assembly (not shown). Lens cover 103 directs the light generated by the lamp assembly (not shown) to an area in front of foot 100. A opaque reflector 141*b* is fitted over bottom wall 141*a* to prevent light from the lamp assembly (not shown) from entering nozzle opening 120. Control panel 104 has apertures formed therein for receiving the nozzle height adjustment lever assembly 106 and agitator shutoff/reset switch assembly 105.

Agitator housing assembly 150 is formed as a single piece wherein the upper portion 151 of the right suction conduit 165 and the upper portion 152 of the left suction conduit 166 are integrally formed extending rearwardly from the nozzle opening 120 and merging back together into the upper portion 153 of a rear suction conduit 167. The upper portion of rectangular suction duct 154 is also formed in rear suction conduit 167 facing rearwardly therefrom. Agitator housing assembly 150 is mounted on the upper side of main body 180 being attached thereto by bosses 175 (FIG. 11) and screws. Main body 180 has the lower portion 176 of right suction conduit, the lower portion 177 of left suction conduit 166, and the lower portion 178 of rear suction conduit 167 integrally formed therein. The lower portion 176 of right suction conduit 165 and the lower portion 177 of left suction conduit 166 extend rearwardly from ledge 182 on the front of main body 180 rearwardly and merge back together into the lower portion 178 of rear suction conduit 167. When agitator housing assembly 150 and main body 180 are assembled, right suction conduit 165, left suction conduit 166, and rear suction conduit 167 are completed fluidly connecting nozzle opening 120 with rear duct 167 and rectangular opening 154. One or more dirt detecting devices such as a microphone may be installed in rear duct 167 as part of a dirt detecting system to detect when dirt particles are flowing therethrough. Such a dirt detecting device is disclosed in U.S. Pat. No. 5,608,944 issued to Gordon. Alternately, the dirt detecting devices may be installed in the suction tube on the cleaner as seen in the Gordon patent.

The suction nozzle main body 180 includes rear wheels 127,127 and a forward but intermediately disposed pivoted, height adjustable wheel carriage 117 having front wheels 128,128. The suction nozzle 10 also includes sidewardly disposed litter picks 118, 118. A furniture guard 119 extends around the suction nozzle 100 front and sides interrupted only by litter picks 118,118. A foot release pedal 107 is disposed at the nozzle's rearward edge.

Still referring specifically to FIG. 6, the suction nozzle 100 includes on its bottom side an abbreviated bottom plate 110 having cross bars 112, 112, 112, 112 and left and right end bars 115,116. Suction openings 117,117,117,117 are disposed between the crossbars 111,111,111,111 and end bars 115,116. The bottom plate 110 is securely mounted to the bottom side of the agitator chamber housing 150 by screws (not shown) and to a ledge 182 on the front of main body 180 by tabs 114,114 that fit into slots 181,181,181 formed in main body 180.

Figure 14:
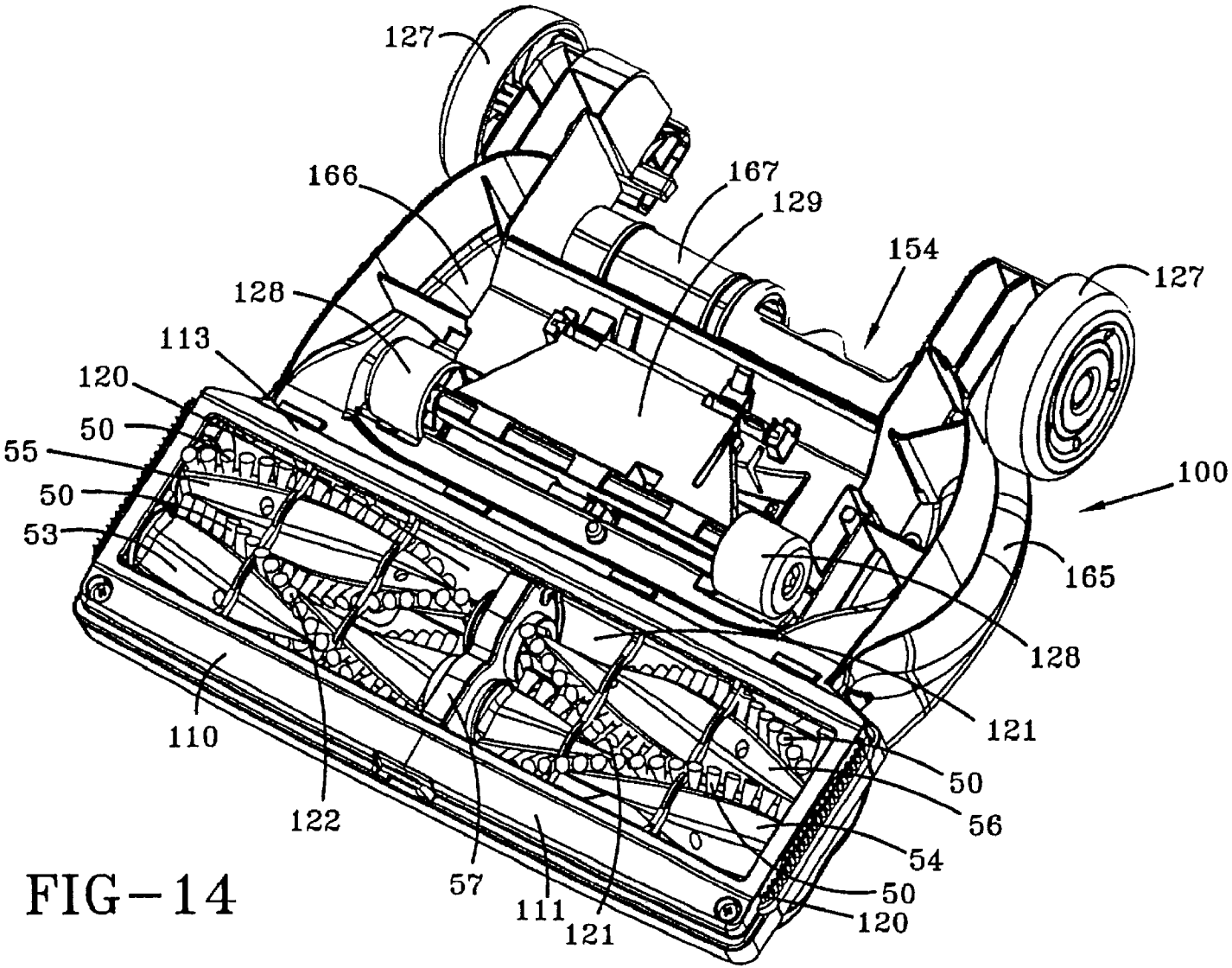
FIG. 14 is a rear elevated view of the assembly shown in FIG. 13 with the addition of the agitator configuration and agitator drive assembly.

A semi-cylindrical shaped nozzle liner 140 is inserted into nozzle opening 120 partially forming the top wall of agitator chambers 121, 122 (FIG. 14). Agitator housing assembly 150 has a pair of channels 161,162 (FIG. 11) integrally formed therein extending from the left and right front edges 159,160, respectively, rearwardly that converge into inlet openings 152*a*, 151*a* of the upper portions 152,151 of right and left suction conduits 165,166. Nozzle liner 140 fits snugly into channels 161,162 (FIG. 12) so that a pair of complete flow passages 134,135 are formed between the upper surface of nozzle liner 140 and agitator housing 150. Flow paths 134,135 extend from a right slotted opening 190 and a left slotted opening 191 to the inlet openings 165*a*, 166*a* of right and left suction conduits 165,166, respectively. Right slotted opening 190 extends parallel to right front edge 159 to a boss 139 on the right side of agitator housing assembly 150 to a protrusion 140*d* on the front edge 140*a* of nozzle line 140. Left slotted opening 191 extends parallel to left front edge 160 to a boss 139 on the left side of agitator housing assembly 150 to protrusion 140*d* on the front edge of nozzle liner 140. A pair of loops 140*g*, 140*g* on opposing ends of nozzle liner 140 encircle bosses 139,139 aid in securing nozzle liner 140 inside nozzle opening 120. Tabs 140*i*,140*h* on nozzle liner 140 and screws are also used. Nozzle liner 140 has a curvilinear rear edge 140*c* which abuts a curvilinear front edge on the lower side of recessed medial portion 141 so that a smooth surface is formed.

Figure 15:
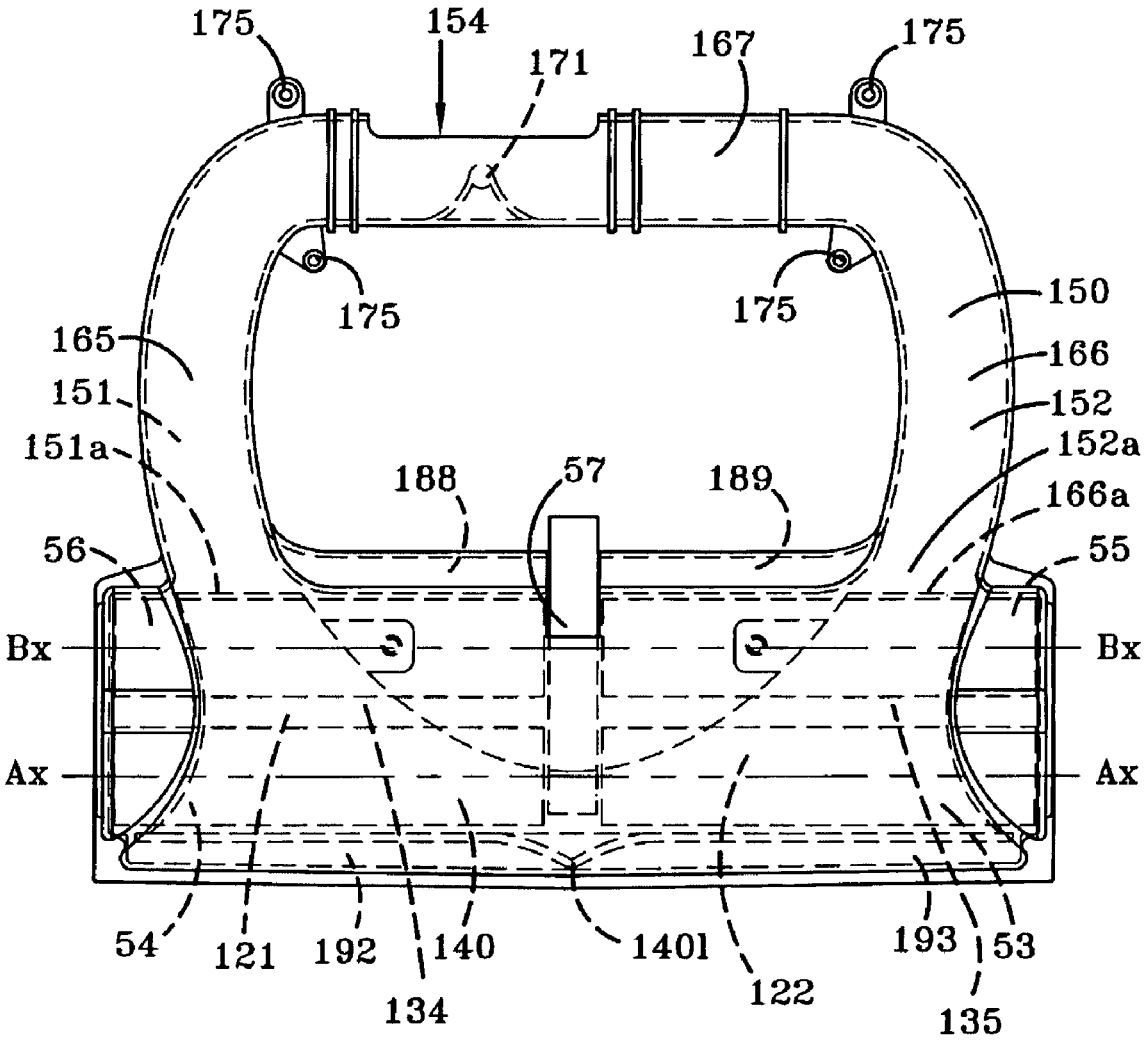
FIG. 15 is a diagrammatic top view of the agitator housing with the nozzle liner installed showing the location of portions of the front and rear suction ducts and the agitator half-sections shown in dashed lines for illustrative purposes only.
Figure 16:
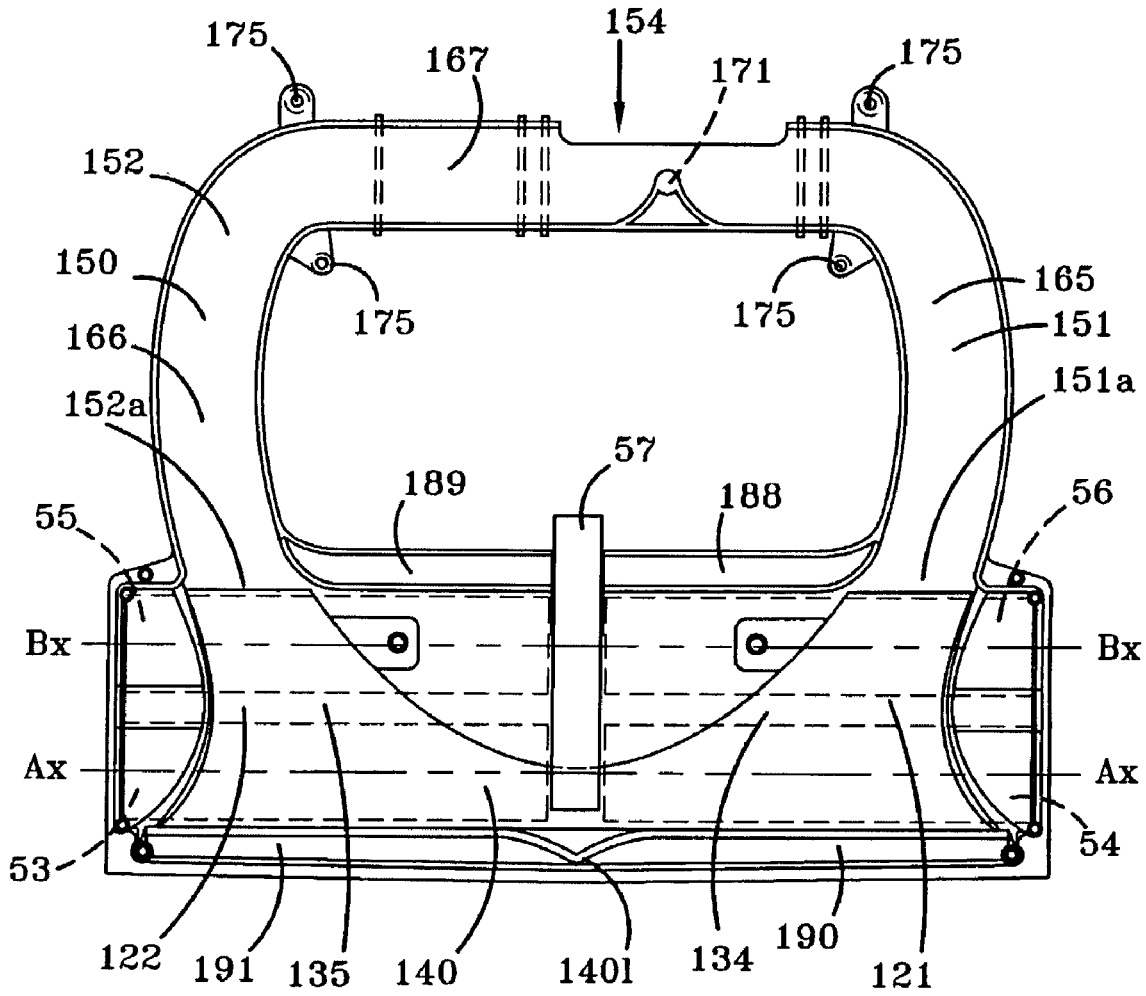
FIG. 16 is a diagrammatic bottom view of the agitator housing with the nozzle liner installed showing the location of the front and rear suction ducts and the agitator half-sections shown in dashed lines for illustrative purposes only.
Figure 17:
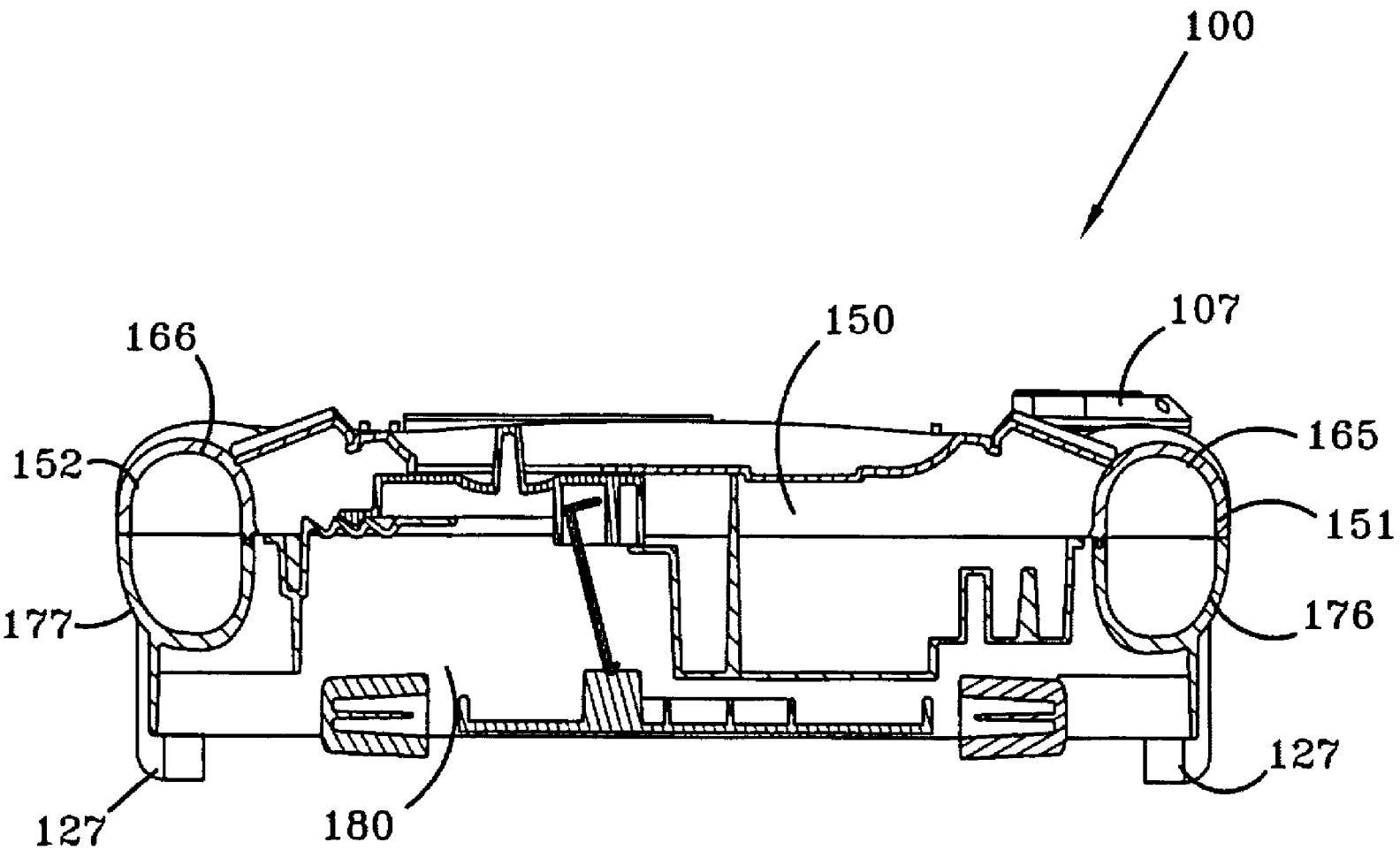
FIG. 17 is a cross-sectional view of the foot of the vacuum cleaner shown in FIGS. 1 and 2 taken along line 17—17 of FIG. 9.

Referring still to FIG. 6, agitator and agitator drive assembly 50 are inserted into nozzle opening 120 after nozzle liner 140 has been installed. When agitator and agitator drive assembly 50 are installed, nozzle opening 120 (FIG. 14) is bifurcated into a right agitator chamber 121 and a left agitator chamber 122. A pair of front and rear agitator half-sections 54, 56 and 53,55 are located in respective right and left agitator chambers 121,122 (FIGS. 14 to 16). A centrally disposed gear box 57 bifurcates nozzle opening 120 (FIG. 14) as well as provides rotary power to both the front and rear agitators 51,52 each comprised of a right and left half-section 54, 56 and 53,55 located in agitator chambers 121,122. Gear box 57 is screwingly mounted to main body 180 and extends forwardly into nozzle opening 120 through a cutout 157 in the bottom wall 141*a* of recessed medial portion 141. An additional boss in bottom wall and screw therethrough into the gear box 57 further secures gear box 57 to the lower surface of bottom wall 141*a*. Once gear box 57 is installed, each of the aforementioned agitator half-sections 54,56 and 53,55 are installed onto the respective drive shafts as previously described. The outward ends of the agitator half-sections 54,56 and 53,55 are rotatably supported by a stub shaft 62 and a spherical bearing 63 located in a pocket (not shown) in bearing end caps 58,58 on opposing sides of foot 100. Bearing end caps 58,58 are installed in cutouts 163,164 formed in the outer ends of agitator housing assembly 150. Bearing end caps 58,58 are securely fastened by tabs 58*a*,58*a*,58*a*,58*a* extending from the lateral sides of bearing end caps 58,58 to bosses 124, 124,124,124 formed in agitator housing assembly 150. Agitator chamber 121 extends from gear box 57 to bearing end cap 58 on the right side of foot 100 and agitator chamber 122 extends from gear box 57 to bearing end cap 58 on the left side of foot 100. Right agitator chamber 121 has a rightwardly extending portion 169 that extends sidewardly beyond the outward edge of right channel 161 and left agitator chamber 122 has a leftwardly extending portion 170 that extends sidewardly beyond the outward edge of left channel 162. The lower surfaces 169*a*, 170*a*, respectively, of left and right sidewardly extending portions 169,170 lie generally in the same plane as the lower surface of the bottom wall 141*a* of recessed medial portion 141 and the lower surface of nozzle liner 140. Together these surfaces form the smooth inner surface of agitator chambers 121,122 having a semi-cylindrical shape. The outer surfaces 169*b*, 170*b* of left and right sidewardly extending portions 169, 170, respectively, have a smooth depressed portion 169*c*, 170*c*, respectively, to give the impression that left and right sidewardly extending portions 169,170 are bifurcated in the lateral direction (as illustrated in FIGS. 15 and 16 by axes Ax and Bx) so that there is a separate chamber for each agitator half-section located beneath.

Referring specifically now to FIG. 11, agitator housing 150 has a right suction channel 155 and a left suction channel 156 adjacent the right and left rear edges of agitator chambers 121,122, respectively. Right suction channel extends from the gear box cutout 157 to the inlet 152*a* of the upper portion 152 of right suction conduit 165. Right suction channel 155 exits into inlet 152*a* by a diverging mouth portion 155*c*. Right suction channel 155 further has rear edge 155*b* and a front edge 155*a* that abuts the rear edge 125 of agitator chamber 121. Left suction channel 156 extends from the gear box cutout 157 to the inlet 151*a* of the upper portion 151 of left suction conduit 166. Left suction channel 156 exits into inlet 151*a* by a diverging mouth portion 156*c*. Left suction channel 156 further has rear edge 156*b* and a front edge 156*a* that abuts the rear edge 126 of agitator chamber 122. However, right suction channel 155 and a left suction channel 156 are only portions of the right and left suction ducts 188,189 adjacent to the rear edges of 125,126 of agitator chambers 121,122. The right and left suction ducts 188,189 are completed when agitator housing 150 and main body 180 are assembled together (FIG. 15) since the main body front ledge 182 serves as the bottom wall for both the right and left suction ducts 188,189 (FIG. 15). Particles deposited on the main body front ledge 182 by rear right agitator half-section 56 and rear left agitator half-section 55 are removed by suction from right and left suction ducts 188,189 (FIGS. 10 and 15). The particles are directed to the inlet openings 165*a*, 166*a* of right and left suction conduits 165,166 before being directed out foot 100 through rear duct 167 and exit opening 154. In addition to removing particles, the right and left suction ducts 188,189 serve to more evenly distribute nozzle suction across the width of agitator chambers 121,122. The rear left and right suction ducts 188,189 may also be seen in the diagrammatic illustrations of agitator housing 150 shown in FIGS. 15 and 16.

Figure 12:
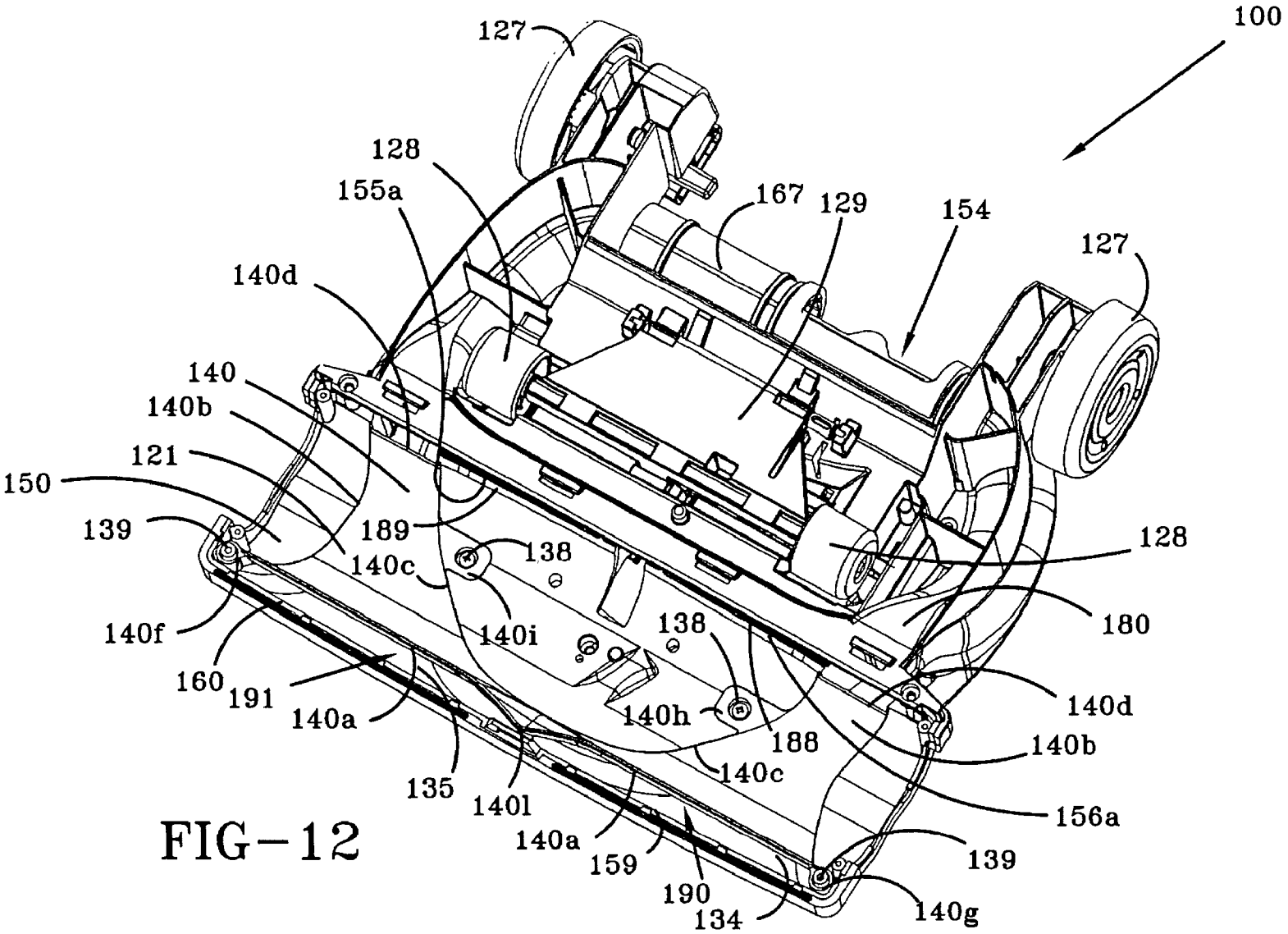
FIG. 12 is a rear elevated view of the agitator housing assembled on the main body of the foot for the vacuum cleaner shown in FIGS. 1 and 2 and the one-piece semi-cylindrical shaped tunnel liner installed in the nozzle chamber of the agitator housing.
Figure 13:
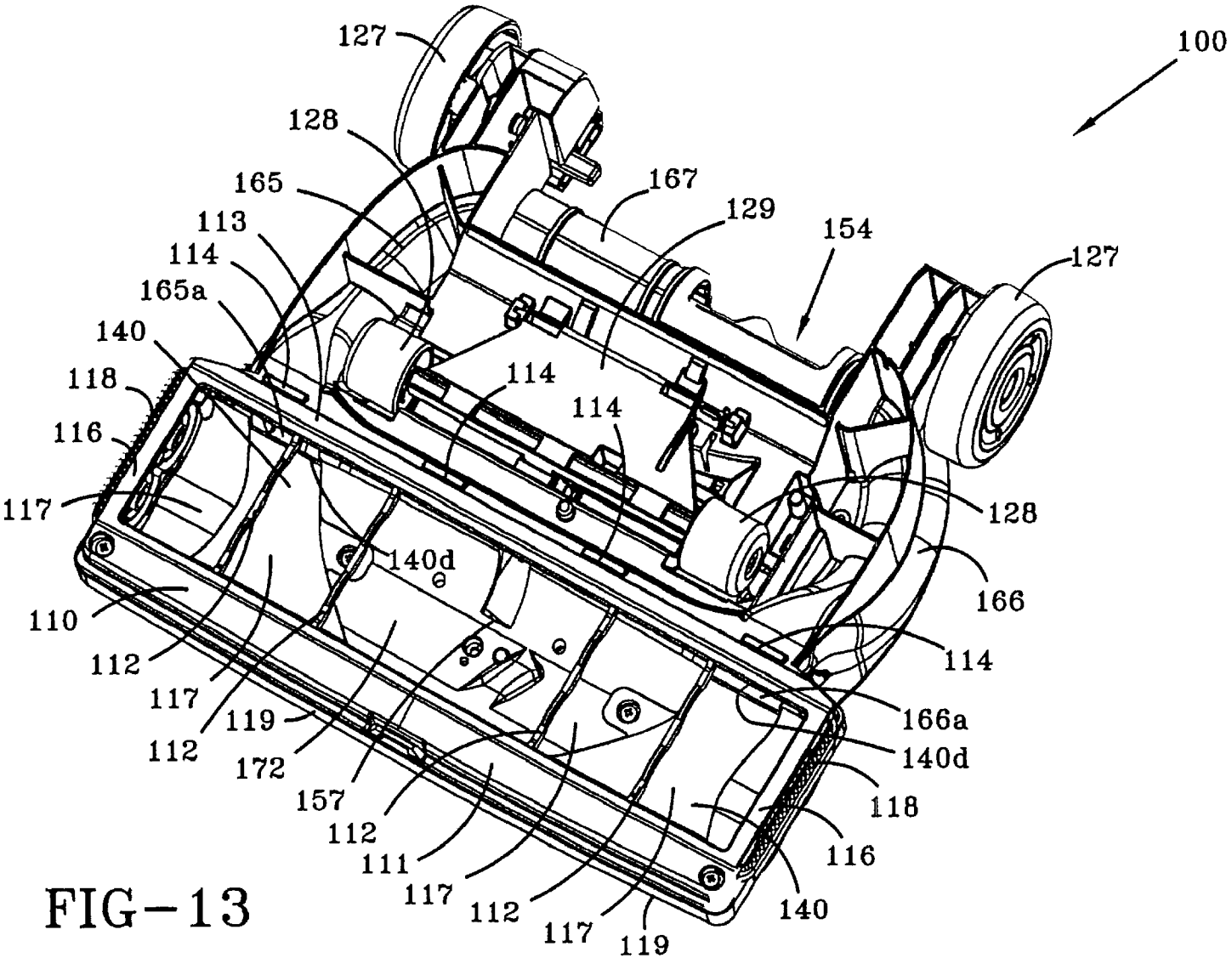
FIG. 13 is a rear elevated view of the assembly shown in FIG. 12 with the addition of the foot bottom plate installed.

Referring now specifically to FIG. 12, shown is a partially assembled foot 100 wherein main body 180 and agitator housing 150 have been assembled and inverted. Nozzle liner 140 has been installed in nozzle opening 120 in agitator housing 150 being fastened therein by tabs 1401,140*h* being secured by screws into bosses 138,138. Once nozzle liner 140 is installed, right and left flow paths 134,135 are completed with right and left slotted openings 190,191, respectively, providing an inlet for particles drawn into right and left agitator chambers 121,122 by nozzle suction. In addition, nozzle suction is distributed along the respective right and left front edges 159,160 of foot 100 more evenly by right and left slotted openings 190,191 to more effectively remove particles from right and left agitator chambers 121,122. However, right and left slotted openings 190,191 only partially form right and left suction ducts 192,193 which are adjacent to right and left front edges 159,160. Right and left suction ducts 192,193 are completed when bottom plate 110 is installed (FIG. 13). This is because the front stringer 111 of bottom plate 110 also serves as the bottom wall of right and left suction ducts 192,193 and as a ledge whereby particles are collected before being removed by nozzle suction through right and left slotted openings 190,191. The particles are drawn into flow paths 134,135 over right and left agitator chambers 121,122 into right and left suction conduits, respectively, through inlet openings 155*a*, 156*a* before converging together in rear duct 167 and exiting the foot 100 through exit opening 154. FIG. 10 shows a cross-sectional view of the left front suction duct 193, slotted opening 191, bottom plate 110 and stringer 111 serving as a particle collecting ledge and duct bottom wall. The front left and right suction ducts 192,193 may also be seen in the diagrammatic illustration of agitator housing 150 shown in FIG. 15.

It should be clear from the foregoing that the described structure clearly meets the objects of the invention set out in the description's beginning. It should now also be obvious that many changes could be made to the disclosed structure which would still fall within its spirit and purview.

The invention claimed is:

1. An improved floor care appliance, comprising:

a suction nozzle for lifting dirt particles from a surface to be cleaned;

a suction source for creating a dirt laden airstream originating at said suction nozzle;

a cleaner housing;

a container removably attached to the cleaner housing and interposed in said dirt laden airstream, the container containing therein a dirt particle filtration and collecting arrangement comprised of:

a wall dividing the container into a first dirt collecting chamber and a second chamber;

a primary filter located in the second chamber for preventing fine dirt particles from exiting said second chamber; and a filtration bag removably inserted into the first dirt collecting chamber and fluidly connected to the dirty air inlet of the container, said filtration bag for separating and collecting large dirt particles.

2. The improved floor care appliance of claim 1 wherein said wall is an apertured wall for providing fluid communication between said first dirt collecting chamber and said second chamber.

3. The improved floor care appliance of claim 1, wherein said filtration bag is a "HEPA" rated filtration bag.

4. The improved floor care appliance of claim 1, wherein said filtration bag includes one or more layers of expanded polytetrafluoroethylene.

5. The improved floor care appliance of claim 1, wherein said primary filter includes a membrane of expanded polytetrafluoroethylene.

6. The improved floor care appliance of claim 1, wherein said dirt container includes a filtration bag connector fluidly connecting said filtration bag to said dirty air inlet.

7. The improved floor care appliance of claim 6, wherein said filtration bag includes a collar having an aperture for connecting said filtration bag to said filtration bag connector.

8. The improved floor care appliance of claim 6, wherein said dirt container includes a plurality of ribs.

9. The improved floor care appliance of claim 8, wherein said plurality of ribs are vertical.

10. An improved floor care appliance, comprising:

a suction nozzle for lifting dirt particles from a surface to be cleaned;

a suction source for creating a dirt laden airstream originating at said suction nozzle;

a cleaner housing;

a container removably attached to the cleaner housing and interposed in the dirt laden airstream, the container containing therein a dirt particle filtration and collecting arrangement comprised of:

an apertured wall dividing the container into a first dirt collecting chamber and a second chamber, the apertured wall for preventing large dirt particles from exiting the first dirt collecting chamber; and a primary filter located in the second chamber for preventing fine dirt particles from exiting said second chamber;

wherein said apertured wall and said primary filter are removable and can be replaced with a filtration bag.

11. The improved floor care appliance of claim 10, wherein said filtration bag is a "HEPA" rated filtration bag.

12. The improved floor care appliance of claim 10, wherein said filtration bag includes one or more layers of expanded polytetrafluoroethylene.

13. The improved floor care appliance of claim 10, wherein said primary filter includes a membrane of expanded polytetrafluoroethylene.

14. The improved floor care appliance of claim 10, wherein said dirt container includes a filtration bag connector fluidly connecting said filtration bag to said dirty air inlet.

15. The improved floor care appliance of claim 14, wherein said filtration bag includes a collar having an aperture for connecting said filtration bag to said filtration bag connector.

16. The improved floor care appliance of claim 10, wherein said container includes a plurality of ribs.

17. A method of providing a filtration arrangement for a floor care appliance having a suction source, a suction nozzle, a housing, and a dirt laden airstream flowing from the suction nozzle generated by said suction source, comprised of the steps of:

removing a dirt container from the housing;

removing a filtration bag from the dirt container;

providing an apertured wall in said dirt container dividing said dirt container into a first dirt collecting chamber and a second chamber;

inserting a filter member in the dirt container; and replacing the dirt container in the cleaner housing interposed in the dirt laden airstream.

18. The method of providing a filtration arrangement for a floor care appliance of claim 17, further including the step of providing a lid on said dirt container before reinserting said container into said housing.

19. A method of providing a multiple filtration arrangement for a floor care appliance having a suction source, a suction nozzle, and a dirt laden airstream flowing from the suction nozzle generated by said suction source, comprised of the steps of:

removing a dirt container from the appliance housing;

inserting a filter member in the dirt container;

inserting a filtration bag into said dirt container; and replacing the dirt container in the cleaner housing interposed in the dirt laden airstream.

20. The method of providing a multiple filtration arrangement for a floor care appliance of claim 19, further including the step of providing a lid on said dirt container before reinserting said container into said housing.

21. The method of providing a multiple filtration arrangement for a floor care appliance of claim 19, further including the step of inserting an air permeable wall into said dirt container dividing the dirt container into a first dirt collecting chamber and a second chamber.

* * * * *